US009734833B2

(12) United States Patent
Disch et al.

(10) Patent No.: US 9,734,833 B2
(45) Date of Patent: Aug. 15, 2017

(54) ENCODER, DECODER AND METHODS FOR BACKWARD COMPATIBLE DYNAMIC ADAPTION OF TIME/FREQUENCY RESOLUTION SPATIAL-AUDIO-OBJECT-CODING

(71) Applicant: Fraunhofer-Gesellschaft zur Foerderung der angewandten Forschung e.V., Munich (DE)

(72) Inventors: Sascha Disch, Fuerth (DE); Jouni Paulus, Erlangen (DE); Bernd Edler, Fuerth (DE); Oliver Hellmuth, Budenhof (DE); Juergen Herre, Erlangen (DE); Thorsten Kastner, Stockheim/Reitsch (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 19 days.

(21) Appl. No.: 14/678,667

(22) Filed: Apr. 3, 2015

(65) Prior Publication Data

US 2015/0279377 A1 Oct. 1, 2015

Related U.S. Application Data

(63) Continuation of application No. PCT/EP2013/070551, filed on Oct. 2, 2013.
(Continued)

(30) Foreign Application Priority Data

May 13, 2013 (EP) ..... 13167481

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/02* (2013.01); *G10L 19/0204* (2013.01); *G10L 19/025* (2013.01); *G10L 19/20* (2013.01)

(58) Field of Classification Search
CPC ... G10L 19/008; G10L 19/20; G10L 19/0204; G10L 19/02; G10L 19/025
See application file for complete search history.

(56) References Cited

U.S. PATENT DOCUMENTS

2007/0078541 A1 4/2007 Rogers
2008/0170711 A1 7/2008 Breebaart et al.
(Continued)

FOREIGN PATENT DOCUMENTS

CN 1307612 C 3/2007
CN 100364235 C 1/2008
(Continued)

OTHER PUBLICATIONS

ISO/IEC, "ISO(IEC FDIS 23003-2:2010 MPEG audio technologies—Part 2: Spatial Audio Object Coding (SAOC)", ISO/IEC JTC1/SC29/WG11 (MPEG) International Standard. Mar. 10, 2010. pp. i-vi.1-78. XP002719104. cited in the application in particular Sections 5.4.2.1 and 7.3 and Figure 3.
(Continued)

*Primary Examiner* — Regina N Holder
(74) *Attorney, Agent, or Firm* — Perkins Coie LLP; Michael A. Glenn

(57) ABSTRACT

A decoder for generating an audio output signal having one or more audio output channels from a downmix signal having a plurality of time-domain downmix samples is provided. The downmix signal encodes two or more audio object signals. The decoder has a window-sequence generator for determining a plurality of analysis windows, each having a plurality of time-domain downmix samples of the
(Continued)

downmix signal and a window length indicating the number of the time-domain downmix samples. Moreover, the decoder has a t/f-analysis module for transforming the plurality of time-domain downmix samples of each analysis window from a time-domain to a time-frequency domain depending on the window length of said analysis window, to obtain a transformed downmix. Furthermore, the decoder has an un-mixing unit for un-mixing the transformed downmix based on parametric side information on the two or more audio object signals to obtain the audio output signal. Moreover, an encoder is provided.

20 Claims, 22 Drawing Sheets

Related U.S. Application Data

(60) Provisional application No. 61/710,133, filed on Oct. 5, 2012.

(51) Int. Cl.

| | |
|---|---|
| ***G10L 19/025*** | (2013.01) |
| ***G10L 19/02*** | (2013.01) |
| *G10L 19/20* | (2013.01) |

(56) References Cited

U.S. PATENT DOCUMENTS

| | | | | |
|---|---|---|---|---|
| 2009/0319283 | A1* | 12/2009 | Schnell | G10L 19/0204 704/503 |
| 2010/0087938 | A1 | 4/2010 | Oh et al. | |
| 2011/0040556 | A1 | 2/2011 | Moon et al. | |
| 2011/0173005 | A1 | 7/2011 | Hilpert et al. | |
| 2012/0177204 | A1 | 7/2012 | Hellmuth et al. | |
| 2012/0243690 | A1 | 9/2012 | Engdegard et al. | |
| 2012/0259643 | A1 | 10/2012 | Engdegard et al. | |

FOREIGN PATENT DOCUMENTS

| | | | |
|---|---|---|---|
| CN | 102640213 | A | 8/2012 |
| EP | 691751 | A1 | 1/1996 |
| EP | 2278582 | A2 | 1/2011 |
| KR | 1020070077134 | A | 7/2007 |
| KR | 20080033909 | | 4/2008 |
| KR | 1020100114450 | A | 10/2010 |
| KR | 1020120062758 | A | 6/2012 |
| RU | 2387023 | C2 | 4/2010 |
| RU | 2420814 | C2 | 6/2011 |
| RU | 2430430 | C2 | 9/2011 |
| WO | 03090208 | A1 | 10/2003 |
| WO | 2006030289 | A1 | 3/2006 |
| WO | 2008120933 | A1 | 10/2008 |
| WO | 2010105695 | A1 | 9/2010 |
| WO | 2010128136 | A1 | 11/2010 |
| WO | 2011101708 | A1 | 8/2011 |
| WO | 2014053547 | A1 | 4/2014 |

OTHER PUBLICATIONS

Koo, Kyungryeol et al., "Variable Subband Analysis for High Quality Spatial Audio Object Coding", IEEE International Conference on Advanced Communication Technology, ICACT 2008, Feb. 17, 2008, pp. 1205-1208.

Tsutsui, K. et al., "ATRAC: Adaptive Transform Acoustic Coding for Minidisc", Preprints of Papers Presented at the AES Convention. vol. 93. No. 3456. Oct. 1, 1992. p. 14PP. XP009029782. In particular Sections 3.1 and 4.

Beack, et al., "An Efficient Time=Frequency Representation for Parametric-Based Audio Object Coding", ETRI Journal, vol. 33, No. 6, Dec. 2011.

Bello, Juan Pablo , "A Tutorial on Onset Detection in Music Signals", IEEE Transactions on SI'EECI-I and AL'DJO Processing, vol. !3, No. 5, Sep. 2005.

Engdegard, J. et al., "Spatial Audio Object Coding (SAOC)—The Upcoming MPEG Standard on Parametric Object Based Audio Coding", Engdegard J. et al: "Spatial Audio Object Coding (SAOC)—The Upcoming MPEG Standard on Parametric Object Based Audio Coding", 124th AES Convention, Audio Engineering Society, Paper 7377, May 17, 2008, pp. 1-15, 2008.

Schuijers, E et al., "Advances in Parametric Coding for High-Quality Audio", 114th AES Convention. Amsterdam, The Netherlands., 2003, 11 Pages.

"Information technology—Coding of moving pictures and associated audio for digital storage media at up to about 1,5 Mbit/s—Part 3: Audio", ISO/IEC 11172-3 First Edition, Aug. 1, 1993, 158 pages.

Bosi, M et al., "ISO/IEC MPEG-2 Advanced Audio Coding", J. Audio Eng. Soc., vol. 45, No. 10, Oct. 1997, pp. 789-814.

Capobianco, Julien et al., "Dynamic Strategy for Window Splitting, Parameters Estimation and Interpolation in Spatial Parametric Audio Coders", Proc. ICASSP 2012, Japan, IEEE, Mar. 25, 2012, pp. 397-400.

Chen, Shuixian et al., "Spatial Parameters for Audio Coding: MDCT domain Analysis and Synthesis, Multimedia Tools and Applications", Multimedia Tools and Applications, vol. 48, No. 2 (First Published Online: Jul. 22, 2009), Jun. 2010, pp. 225-246.

Edler, B, "Aliasing reduction in subbands of cascaded filterbanks with decimation", Electronic Letters, vol. 28, No. 12, Jun. 1992, pp. 1104-1106.

Faller, C., "Parametric Joint-Coding of Audio Sources", AES Convention Paper 6752, Presented at the 120th Convention, Paris, France, May 20-23, 2006, 12 pages.

Faller, Christof et al., "Binaural Cue Coding—Part II: Schemes and applications", IEEE Transactions on speech and audio processing, vol. 11, No. 6, Nov. 2003, pp. 520-531.

Girin, L. et al., "Informed Audio Source Separation from Compressed Linear Stereo Mixtures", AES 42nd International Conference: Semantic Audio, Ilmenau, Germany, Jul. 22-24, 2011, 10 pages.

Herre, et al., "From SAC to SAOC—Recent Developments in Parametric Coding of Spatial Audio", Illusions in Sound, AES 22nd UK Conference, Apr. 2007, 8 pages.

Liutkus, A. et al., "Informed source separation through spectrogram coding and data embedding", Signal Processing Journal, Jul. 18, 2011, 30 pages.

Nesbit, Andrew et al., "Benchmarking Flexible Adaptive Time-Frequency Transforms for Underdetermined Audio Source Separation", IEEE International Conference on Acoustics, Speech and Signal Processing, Apr. 19-24, 2009, pp. 37-40.

Ozerov, et al., "Informed source separation: source coding meets source separation", IEEE Workshop on Applications of Signal Processing to Audio and Acoustics; Mohonk, NY, Oct. 2011, 5 pages.

Parvaix, M et al., "A Watermarking-Based Method for Informed Source Separation of Audio Signals With a Single Sensor", IEEE Transactions on Audio, Speech and Language Processing, vol. 18, No. 6, Aug. 2010, pp. 1464-1475.

Parvaix, M. et al., "Informed Source Separation of underdetermined instantaneous Stereo Mixtures using Source Index Embedding", IEEE ICASSP, Mar. 2010, pp. 245-248.

Zhang, S. et al., "An informed source separation system for speech signals", 12th Annual Conference of the International Speech Communication Association (Interspeech 2011), Aug. 2011, pp. 573-576.

* cited by examiner

ENCODER, DECODER AND METHODS FOR BACKWARD COMPATIBLE DYNAMIC ADAPTION OF TIME/FREQUENCY RESOLUTION SPATIAL-AUDIO-OBJECT-CODING

CROSS-REFERENCE TO RELATED APPLICATIONS

This application is a continuation of copending International Application No. PCT/EP2013/070551, filed Oct. 2, 2013, which is incorporated herein by reference in its entirety, and additionally claims priority from U.S. Provisional Application No. 61/710,133, filed Oct. 5, 2012, and from European Application No. 13167481.4, filed May 13, 2013, which are also incorporated herein by reference in their entirety.

BACKGROUND OF THE INVENTION

The present invention relates to audio signal encoding, audio signal decoding and audio signal processing, and, in particular, to an encoder, a decoder and methods for backward compatible dynamic adaptation of time/frequency resolution in spatial-audio-object-coding (SAOC).

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example, in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bitrate efficient way. Therefore, one is willing to accept a reasonable tradeoff between audio quality and bitrate requirements in order to avoid an excessive resource load caused by multi-channel/multi-object applications.

Recently, in the field of audio coding, parametric techniques for the bitrate-efficient transmission/storage of multi-channel/multi-object audio signals have been introduced by, e.g., the Moving Picture Experts Group (MPEG) and others. One example is MPEG Surround (MPS) as a channel oriented approach [MPS, BCC], or MPEG Spatial Audio Object Coding (SAOC) as an object oriented approach [JSC, SAOC, SAOC1, SAOC2]. Another object—oriented approach is termed as "informed source separation" [ISS1, ISS2, ISS3, ISS4, ISS5, ISS6]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 3, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band, as depicted in FIG. 3:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (side-information-estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 3. The desired target scene may be, in the extreme case, the rendering of only one source signal out of the mixture (source separation scenario), but also any other arbitrary acoustic scene consisting of the objects transmitted. For example, the output can be a single-channel, a 2-channel stereo or 5.1 multi-channel target scene.

Time-frequency based systems may utilize a time-frequency (t/f) transform with static temporal and frequency resolution. Choosing a certain fixed t/f-resolution grid typically involves a trade-off between time and frequency resolution.

The effect of a fixed t/f-resolution can be demonstrated on the example of typical object signals in an audio signal mixture. For example, the spectra of tonal sounds exhibit a harmonically related structure with a fundamental frequency and several overtones. The energy of such signals is concentrated at certain frequency regions. For such signals, a high frequency resolution of the utilized t/f-representation is beneficial for separating the narrowband tonal spectral regions from a signal mixture. In the contrary, transient signals, like drum sounds, often have a distinct temporal structure: substantial energy is only present for short periods of time and is spread over a wide range of frequencies. For these signals, a high temporal resolution of the utilized t/f-representation is advantageous for separating the transient signal portion from the signal mixture.

Current audio object coding schemes offer only a limited variability in the time-frequency selectivity of the SAOC processing. For instance, MPEG SAOC [SAOC] [SAOC1] [SAOC2] is limited to the time-frequency resolution that can be obtained by the use of the so-called Hybrid Quadrature Mirror Filter Bank (Hybrid-QMF) and its subsequent grouping into parametric bands. Therefore, object restoration in standard SAOC (MPEG SAOC, as standardized in [SAOC]) often suffers from the coarse frequency resolution of the Hybrid-QMF leading to audible modulated crosstalk from the other audio objects (e.g., double-talk artifacts in speech or auditory roughness artifacts in music).

Audio object coding schemes, such as Binaural Cue Coding [BCC] and Parametric Joint-Coding of Audio Sources [JSC], are also limited to the use of one fixed resolution filter bank. The actual choice of a fixed resolution filter bank or transform involves a predefined trade-off in terms of optimality between temporal and spectral properties of the coding scheme.

In the field of informed source separation (ISS), it has been suggested to dynamically adapt the time frequency transform length to the properties of the signal [ISS7] as well known from perceptual audio coding schemes, e.g., Advanced Audio Coding (AAC) [AAC].

SUMMARY

According to an embodiment, a decoder for generating an audio output signal having one or more audio output channels from a downmix signal having a plurality of time-domain downmix samples, wherein the downmix signal encodes two or more audio object signals, may have: a window-sequence generator for determining a plurality of analysis windows, wherein each of the analysis windows has a plurality of time-domain downmix samples of the downmix signal, wherein each analysis window of the plurality of analysis windows has a window length indicating the number of the time-domain downmix samples of said analysis window, wherein the window-sequence generator is configured to determine the plurality of analysis windows so that the window length of each of the analysis windows depends on a signal property of at least one of the two or more audio object signals, a t/f-analysis module for transforming the plurality of time-domain downmix samples of each analysis window of the plurality of analysis windows from a time-domain to a time-frequency domain depending on the window length of said analysis window, to obtain a transformed downmix, and an un-mixing unit for un-mixing the transformed downmix based on parametric side information on the two or more audio object signals to obtain the audio output signal.

According to another embodiment, a decoder for generating an audio output signal having one or more audio output channels from a downmix signal having a plurality of time-domain downmix samples, wherein the downmix signal encodes two or more audio object signals, may have: a first analysis submodule for transforming the plurality of time-domain downmix samples to obtain a plurality of subbands having a plurality of subband samples, a window-sequence generator for determining a plurality of analysis windows, wherein each of the analysis windows has a plurality of subband samples of one of the plurality of subbands, wherein each analysis window of the plurality of analysis windows has a window length indicating the number of subband samples of said analysis window, wherein the window-sequence generator is configured to determine the plurality of analysis windows so that the window length of each of the analysis windows depends on a signal property of at least one of the two or more audio object signals, a second analysis module for transforming the plurality of subband samples of each analysis window of the plurality of analysis windows depending on the window length of said analysis window to obtain a transformed downmix, and an un-mixing unit for un-mixing the transformed downmix based on parametric side information on the two or more audio object signals to obtain the audio output signal.

According to another embodiment, an encoder for encoding two or more input audio object signals, wherein each of the two or more input audio object signals has a plurality of time-domain signal samples, may have: a window-sequence unit for determining a plurality of analysis windows, wherein each of the analysis windows has a plurality of the time-domain signal samples of one of the input audio object signals, wherein each of the analysis windows has a window length indicating the number of time-domain signal samples of said analysis window, wherein the window-sequence unit is configured to determine the plurality of analysis windows so that the window length of each of the analysis windows depends on a signal property of at least one of the two or more input audio object signals, a t/f-analysis unit for transforming the time-domain signal samples of each of the analysis windows from a time-domain to a time-frequency domain to obtain transformed signal samples, wherein the t/f-analysis unit is configured to transform the plurality of time-domain signal samples of each of the analysis windows depending on the window length of said analysis window, and a PSI-estimation unit for determining parametric side information depending on the transformed signal samples.

According to still another embodiment, an encoder for encoding two or more input audio object signals, wherein each of the two or more input audio object signals has a plurality of time-domain signal samples, may have: a first analysis submodule for transforming the plurality of time-domain signal samples to obtain a plurality of subbands having a plurality of subband samples, a window-sequence unit for determining a plurality of analysis windows, wherein each of the analysis windows has a plurality of subband samples of one of the plurality of subbands, wherein each of the analysis windows has a window length indicating the number of subband samples of said analysis window, wherein the window-sequence unit is configured to determine the plurality of analysis windows so that the window length of each of the analysis windows depends on a signal property of at least one of the two or more input audio object signals, a second analysis module for transforming the plurality of subband samples of each analysis window of the plurality of analysis windows depending on the window length of said analysis window to obtain transformed signal samples, and a PSI-estimation unit for determining parametric side information depending on the transformed signal samples.

According to another embodiment, a method for decoding for generating an audio output signal having one or more audio output channels from a downmix signal having a plurality of time-domain downmix samples, wherein the downmix signal encodes two or more audio object signals, may have the steps of: determining a plurality of analysis windows, wherein each of the analysis windows has a plurality of time-domain downmix samples of the downmix signal, wherein each analysis window of the plurality of analysis windows has a window length indicating the number of the time-domain downmix samples of said analysis window, wherein determining the plurality of analysis windows is conducted so that the window length of each of the analysis windows depends on a signal property of at least one of the two or more audio object signals, transforming the plurality of time-domain downmix samples of each analysis window of the plurality of analysis windows from a time-domain to a time-frequency domain depending on the window length of said analysis window, to obtain a transformed downmix, and un-mixing the transformed downmix based on parametric side information on the two or more audio object signals to obtain the audio output signal.

According to another embodiment, a method for encoding two or more input audio object signals, wherein each of the two or more input audio object signals has a plurality of time-domain signal samples, may have the steps of: determining a plurality of analysis windows, wherein each of the analysis windows has a plurality of the time-domain signal samples of one of the input audio object signals, wherein each of the analysis windows has a window length indicating the number of time-domain signal samples of said analysis window, wherein determining the plurality of analysis windows is conducted so that the window length of each of the analysis windows depends on a signal property of at least one of the two or more input audio object signals, transforming the time-domain signal samples of each of the analysis windows from a time-domain to a time-frequency domain to obtain transformed signal samples, wherein transforming the plurality of time-domain signal samples of each of the analysis windows depends on the window length of said analysis window, determining parametric side information depending on the transformed signal samples.

According to another embodiment, a method for decoding by generating an audio output signal having one or more audio output channels from a downmix signal having a plurality of time-domain downmix samples, wherein the downmix signal encodes two or more audio object signals, may have the steps of: transforming the plurality of time-domain downmix samples to obtain a plurality of subbands having a plurality of subband samples, determining a plurality of analysis windows, wherein each of the analysis windows has a plurality of subband samples of one of the plurality of subbands, wherein each analysis window of the plurality of analysis windows has a window length indicating the number of subband samples of said analysis window, wherein determining the plurality of analysis windows is conducted so that the window length of each of the analysis windows depends on a signal property of at least one of the two or more audio object signals, transforming the plurality of subband samples of each analysis window of the plurality of analysis windows depending on the window length of said analysis window to obtain a transformed downmix, and un-mixing the transformed downmix based on parametric side information on the two or more audio object signals to obtain the audio output signal.

According to another embodiment, a method for encoding two or more input audio object signals, wherein each of the two or more input audio object signals has a plurality of time-domain signal samples, may have the steps of: transforming the plurality of time-domain signal samples to obtain a plurality of subbands having a plurality of subband samples, determining a plurality of analysis windows, wherein each of the analysis windows has a plurality of subband samples of one of the plurality of subbands, wherein each of the analysis windows has a window length indicating the number of subband samples of said analysis window, wherein determining the plurality of analysis windows is conducted so that the window length of each of the analysis windows depends on a signal property of at least one of the two or more input audio object signals, transforming the plurality of subband samples of each analysis window of the plurality of analysis windows depending on the window length of said analysis window to obtain transformed signal samples, and determining parametric side information depending on the transformed signal samples.

Another embodiment may have a computer program for implementing the methods for decoding and encoding mentioned above when being executed on a computer or signal processor.

In contrast to state-of-the-art SAOC, embodiments are provided to dynamically adapt the time-frequency resolution to the signal in a backward compatible way, such that

- SAOC parameter bit streams originating from a standard SAOC encoder (MPEG SAOC, as standardized in [SAOC]) can still be decoded by an enhanced decoder with a perceptual quality comparable to the one obtained with a standard decoder,
- enhanced SAOC parameter bit streams can be decoded with optimal quality with the enhanced decoder, and
- standard and enhanced SAOC parameter bit streams can be mixed, e.g., in a multi-point control unit (MCU) scenario, into one common bit stream which can be decoded with a standard or an enhanced decoder.

For the above mentioned properties, it is useful to provide for a common filter bank/transform representation that can be dynamically adapted in time-frequency resolution to either support the decoding of the novel enhanced SAOC data and, at the same time, the backward compatible mapping of traditional standard SAOC data. The merging of enhanced SAOC data and standard SAOC data is possible given such a common representation.

An enhanced SAOC perceptual quality can be obtained by dynamically adapting the time-frequency resolution of the filter bank or transform that is employed to estimate or used to synthesize the audio object cues to specific properties of the input audio object. For instance, if the audio object is quasi-stationary during a certain time span, parameter estimation and synthesis is beneficially performed on a coarse time resolution and a fine frequency resolution. If the audio object contains transients or non-stationaries during a certain time span, parameter estimation and synthesis is advantageously done using a fine time resolution and a coarse frequency resolution. Thereby, the dynamic adaptation of the filter bank or transform allows for

- a high frequency selectivity in the spectral separation of quasi-stationary signals in order to avoid inter-object crosstalk, and
- high temporal precision for object onsets or transient events in order to minimize pre- and post-echoes.

At the same time, traditional SAOC quality can be obtained by mapping standard SAOC data onto the time-frequency grid provided by the inventive backward compatible signal adaptive transform that depends on side information describing the object signal characteristics.

Being able to decode both standard and enhanced SAOC data using one common transform enables direct backward compatibility for applications that encompass mixing of standard and novel enhanced SAOC data.

A decoder for generating an audio output signal comprising one or more audio output channels from a downmix signal comprising a plurality of time-domain downmix samples is provided. The downmix signal encodes two or more audio object signals.

The decoder comprises a window-sequence generator or determining a plurality of analysis windows, wherein each of the analysis windows comprises a plurality of time-domain downmix samples of the downmix signal. Each analysis window of the plurality of analysis windows has a window length indicating the number of the time-domain downmix samples of said analysis window. The window-sequence generator is configured to determine the plurality of analysis windows so that the window length of each of the analysis windows depends on a signal property of at least one of the two or more audio object signals.

Moreover, the decoder comprises a t/f-analysis module for transforming the plurality of time-domain downmix samples of each analysis window of the plurality of analysis windows from a time-domain to a time-frequency domain depending on the window length of said analysis window, to obtain a transformed downmix.

Furthermore, the decoder comprises an un-mixing unit for un-mixing the transformed downmix based on parametric side information on the two or more audio object signals to obtain the audio output signal.

According to an embodiment, the window-sequence generator may be configured to determine the plurality of analysis windows, so that a transient, indicating a signal change of at least one of the two or more audio object signals being encoded by the downmix signal, is comprised by a first analysis window of the plurality of analysis windows and by a second analysis window of the plurality of analysis windows, wherein a center $c_k$ of the first analysis window is defined by a location t of the transient according to $c_k=t-l_b$, and a center $c_{k+1}$ of the first analysis window is defined by the location t of the transient according to $c_{k+1}=t+l_a$, wherein $l_a$ and $l_b$ are numbers.

In an embodiment, the window-sequence generator may be configured to determine the plurality of analysis windows, so that a transient, indicating a signal change of at least one of the two or more audio object signals being encoded by the downmix signal, is comprised by a first analysis window of the plurality of analysis windows, wherein a center $c_k$ of the first analysis window is defined by a location t of the transient according to $c_k=t$, wherein a center $c_{k-1}$ of a second analysis window of the plurality of analysis windows is defined by a location t of the transient according to $c_{k-1}=t-l_b$, and wherein a center $c_{k+1}$ of a third analysis window of the plurality of analysis windows is defined by a location t of the transient according to $c_{k+1}=t+l_a$, wherein $l_a$ and $l_b$ are numbers.

According to an embodiment, the window-sequence generator may be configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient, indicating a signal change of at least one of the two or more audio object signals being encoded by the downmix signal.

In an embodiment, the t/f-analysis module may be configured to transform the time-domain downmix samples of each of the analysis windows from a time-domain to a time-frequency domain by employing a QMF filter bank and a Nyquist filter bank, wherein the t/f-analysis unit (135) is configured to transform the plurality of time-domain signal samples of each of the analysis windows depending on the window length of said analysis window.

Moreover, an encoder for encoding two or more input audio object signals is provided. Each of the two or more input audio object signals comprises a plurality of time-domain signal samples. The encoder comprises a window-sequence unit for determining a plurality of analysis windows. Each of the analysis windows comprises a plurality of the time-domain signal samples of one of the input audio object signals, wherein each of the analysis windows has a window length indicating the number of time-domain signal samples of said analysis window. The window-sequence unit is configured to determine the plurality of analysis windows so that the window length of each of the analysis windows depends on a signal property of at least one of the two or more input audio object signals.

Moreover, the encoder comprises a t/f-analysis unit for transforming the time-domain signal samples of each of the analysis windows from a time-domain to a time-frequency domain to obtain transformed signal samples. The t/f-analysis unit may be configured to transform the plurality of time-domain signal samples of each of the analysis windows depending on the window length of said analysis window.

Furthermore, the encoder comprises PSI-estimation unit for determining parametric side information depending on the transformed signal samples.

In an embodiment, the encoder may further comprise a transient-detection unit being configured to determine a plurality of object level differences of the two or more input audio object signals, and being configured to determine, whether a difference between a first one of the object level differences and a second one of object level differences is greater than a threshold value, to determine for each of the analysis windows, whether said analysis window comprises a transient, indicating a signal change of at least one of the two or more input audio object signals.

According to an embodiment, the transient-detection unit may be configured to employ a detection function d(n) to determine whether the difference between the first one of the object level differences and the second one of object level differences is greater than the threshold value, wherein the detection function d(n) is defined as:

$$d(n) = \sum_{i,j} |\log(OLD_{i,j}(b, n-1)) - \log(OLD_{i,j}(b, n))|$$

wherein n indicates an index, wherein i indicates a first object, wherein j indicates a second object, wherein b indicates a parametric band. OLD may, for example, indicate an object level difference.

In an embodiment, the window-sequence unit may be configured to determine the plurality of analysis windows, so that a transient, indicating a signal change of at least one of the two or more input audio object signals, is comprised by a first analysis window of the plurality of analysis windows and by a second analysis window of the plurality of analysis windows, wherein a center $c_k$ of the first analysis window is defined by a location t of the transient according to $c_k=t-l_b$, and a center $c_{k+1}$ of the first analysis window is defined by the location t of the transient according to $c_{k+1}=t+l_a$, wherein $l_a$ and $l_b$ are numbers.

According to an embodiment, the window-sequence unit may be configured to determine the plurality of analysis windows, so that a transient, indicating a signal change of at least one of the two or more input audio object signals, is comprised by a first analysis window of the plurality of analysis windows, wherein a center $c_k$ of the first analysis window is defined by a location t of the transient according to $c_k=t$, wherein a center $c_{k-1}$ of a second analysis window of the plurality of analysis windows is defined by a location t of the transient according to $c_{k-1}=t-l_b$, and wherein a center $c_{k+1}$ of a third analysis window of the plurality of analysis windows is defined by a location t of the transient according to $c_{k+1}=t+l_a$, wherein $l_a$ and $l_b$ are numbers.

In an embodiment, the window-sequence unit may be configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient, indicating a signal change of at least one of the two or more input audio object signals.

According to an embodiment, the t/f-analysis unit may be configured to transform the time-domain signal samples of each of the analysis windows from a time-domain to a time-frequency domain by employing a QMF filter bank and a Nyquist filter bank, wherein the t/f-analysis unit may be configured to transform the plurality of time-domain signal samples of each of the analysis windows depending on the window length of said analysis window.

Moreover, a decoder for generating an audio output signal comprising one or more audio output channels from a downmix signal comprising a plurality of time-domain downmix samples is provided. The downmix signal encodes two or more audio object signals. The decoder comprises a first analysis submodule for transforming the plurality of time-domain downmix samples to obtain a plurality of subbands comprising a plurality of subband samples. Moreover, the decoder comprises a window-sequence generator for determining a plurality of analysis windows, wherein each of the analysis windows comprises a plurality of subband samples of one of the plurality of subbands, wherein each analysis window of the plurality of analysis windows has a window length indicating the number of subband samples of said analysis window, wherein the window-sequence generator is configured to determine the plurality of analysis windows so that the window length of each of the analysis windows depends on a signal property of at least one of the two or more audio object signals. Furthermore, the decoder comprises a second analysis module for transforming the plurality of subband samples of each analysis window of the plurality of analysis windows depending on the window length of said analysis window to obtain a transformed downmix. Furthermore, the decoder comprises an un-mixing unit for un-mixing the transformed downmix based on parametric side information on the two or more audio object signals to obtain the audio output signal.

Furthermore, an encoder for encoding two or more input audio object signals is provided. Each of the two or more input audio object signals comprises a plurality of time-domain signal samples. The encoder comprises a first analysis submodule for transforming the plurality of time-domain signal samples to obtain a plurality of subbands comprising a plurality of subband samples. Moreover, the encoder comprises a window-sequence unit for determining a plurality of analysis windows, wherein each of the analysis windows comprises a plurality of subband samples of one of the plurality of subbands, wherein each of the analysis windows has a window length indicating the number of subband samples of said analysis window, wherein the window-sequence unit is configured to determine the plurality of analysis windows so that the window length of each of the analysis windows depends on a signal property of at least one of the two or more input audio object signals. Furthermore, the encoder comprises a second analysis module for transforming the plurality of subband samples of each analysis window of the plurality of analysis windows depending on the window length of said analysis window to obtain transformed signal samples. Moreover, the encoder comprises a PSI-estimation unit for determining parametric side information depending on the transformed signal samples.

Moreover, decoder for generating an audio output signal comprising one or more audio output channels from a downmix signal is provided. The downmix signal encodes one or more audio object signals. The decoder comprises a control unit for setting an activation indication to an activation state depending on a signal property of at least one of the one or more audio object signals. Moreover, the decoder comprises a first analysis module for transforming the downmix signal to obtain a first transformed downmix comprising a plurality of first subband channels. Furthermore, the decoder comprises a second analysis module for generating, when the activation indication is set to the activation state, a second transformed downmix by transforming at least one of the first subband channels to obtain a plurality of second subband channels, wherein the second transformed downmix comprises the first subband channels which have not been transformed by the second analysis module and the second subband channels. Moreover, the decoder comprises an un-mixing unit, wherein the un-mixing unit is configured to un-mix the second transformed downmix, when the activation indication is set to the activation state, based on parametric side information on the one or more audio object signals to obtain the audio output signal, and to un-mix the first transformed downmix, when the activation indication is not set to the activation state, based on the parametric side information on the one or more audio object signals to obtain the audio output signal.

Furthermore, an encoder for encoding an input audio object signal is provided. The encoder comprises a control unit for setting an activation indication to an activation state depending on a signal property of the input audio object signal. Moreover, the encoder comprises a first analysis module for transforming the input audio object signal to obtain a first transformed audio object signal, wherein the first transformed audio object signal comprises a plurality of first subband channels. Furthermore, the encoder comprises a second analysis module for generating, when the activation indication is set to the activation state, a second transformed audio object signal by transforming at least one of the plurality of first subband channels to obtain a plurality of second subband channels, wherein the second transformed audio object signal comprises the first subband channels which have not been transformed by the second analysis module and the second subband channels. Moreover, the encoder comprises a PSI-estimation unit, wherein the PSI-estimation unit is configured to determine parametric side information based on the second transformed audio object signal, when the activation indication is set to the activation state, and to determine the parametric side information based on the first transformed audio object signal, when the activation indication is not set to the activation state.

Moreover, a method for decoding for generating an audio output signal comprising one or more audio output channels from a downmix signal comprising a plurality of time-domain downmix samples is provided. The downmix signal encodes two or more audio object signals. The method comprises:

Determining a plurality of analysis windows, wherein each of the analysis windows comprises a plurality of time-domain downmix samples of the downmix signal, wherein each analysis window of the plurality of analysis windows has a window length indicating the number of the time-domain downmix samples of said analysis window, wherein determining the plurality of analysis windows is conducted so that the window length of each of the analysis windows depends on a signal property of at least one of the two or more audio object signals.

Transforming the plurality of time-domain downmix samples of each analysis window of the plurality of analysis windows from a time-domain to a time-frequency domain depending on the window length of said analysis window, to obtain a transformed downmix, and Un-mixing the transformed downmix based on parametric side information on the two or more audio object signals to obtain the audio output signal, Furthermore, a method for encoding two or more input audio object signals is provided. Each of the two or more input audio object signals comprises a plurality of time-domain signal samples. The method comprises:

Determining a plurality of analysis windows, wherein each of the analysis windows comprises a plurality of the time-domain signal samples of one of the input audio object signals, wherein each of the analysis windows has a window length indicating the number of time-domain signal samples of said analysis window, wherein determining the plurality of analysis windows is conducted so that the window length of each of the analysis windows depends on a signal property of at least one of the two or more input audio object signals.

Transforming the time-domain signal samples of each of the analysis windows from a time-domain to a time-frequency domain to obtain transformed signal samples, wherein transforming the plurality of time-domain signal samples of each of the analysis windows depends on the window length of said analysis window. And:

Determining parametric side information depending on the transformed signal samples.

Moreover, a method for decoding by generating an audio output signal comprising one or more audio output channels from a downmix signal comprising a plurality of time-domain downmix samples, wherein the downmix signal encodes two or more audio object signals, is provided. The method comprises:

Transforming the plurality of time-domain downmix samples to obtain a plurality of subbands comprising a plurality of subband samples.

Determining a plurality of analysis windows, wherein each of the analysis windows comprises a plurality of subband samples of one of the plurality of subbands, wherein each analysis window of the plurality of analysis windows has a window length indicating the number of subband samples of said analysis window, wherein determining the plurality of analysis windows is conducted so that the window length of each of the analysis windows depends on a signal property of at least one of the two or more audio object signals.

Transforming the plurality of subband samples of each analysis window of the plurality of analysis windows depending on the window length of said analysis window to obtain a transformed downmix. And:

Un-mixing the transformed downmix based on parametric side information on the two or more audio object signals to obtain the audio output signal.

Furthermore, a method for encoding two or more input audio object signals, wherein each of the two or more input audio object signals comprises a plurality of time-domain signal samples, is provided. The method comprises:

Transforming the plurality of time-domain signal samples to obtain a plurality of subbands comprising a plurality of subband samples.

Determining a plurality of analysis windows, wherein each of the analysis windows comprises a plurality of subband samples of one of the plurality of subbands, wherein each of the analysis windows has a window length indicating the number of subband samples of said analysis window, wherein determining the plurality of analysis windows is conducted so that the window length of each of the analysis windows depends on a signal property of at least one of the two or more input audio object signals.

Transforming the plurality of subband samples of each analysis window of the plurality of analysis windows depending on the window length of said analysis window to obtain transformed signal samples. And Determining parametric side information depending on the transformed signal samples.

Moreover, a method for decoding by generating an audio output signal comprising one or more audio output channels from a downmix signal, wherein the downmix signal encodes two or more audio object signals, is provided. The method comprises:

Setting an activation indication to an activation state depending on a signal property of at least one of the two or more audio object signals.

Transforming the downmix signal to obtain a first transformed downmix comprising a plurality of first subband channels.

Generating, when the activation indication is set to the activation state, a second transformed downmix by transforming at least one of the first subband channels to obtain a plurality of second subband channels, wherein the second transformed downmix comprises the first subband channels which have not been transformed by the second analysis module and the second subband channels. And:

Un-mixing the second transformed downmix, when the activation indication is set to the activation state, based on parametric side information on the two or more audio object signals to obtain the audio output signal, and un-mixing the first transformed downmix, when the activation indication is not set to the activation state, based on the parametric side information on the two or more audio object signals to obtain the audio output signal.

Furthermore, a method for encoding two or more input audio object signals is provided. The method comprises:

Setting an activation indication to an activation state depending on a signal property of at least one of the two or more input audio object signals.

Transforming each of the input audio object signals to obtain a first transformed audio object signal of said input audio object signal, wherein said first transformed audio object signal comprises a plurality of first subband channels.

Generating for each of the input audio object signals, when the activation indication is set to the activation state, a second transformed audio object signal by transforming at least one of the first subband channels of the first transformed audio object signal of said input audio object signal to obtain a plurality of second subband channels, wherein said second transformed downmix comprises said first subband channels which have not been transformed by the second analysis module and said second subband channels. And:

Determining parametric side information based on the second transformed audio object signal of each of the input audio object signals, when the activation indication is set to the activation state, and determining the parametric side information based on the first transformed audio object signal of each of the input audio object signals, when the activation indication is not set to the activation state.

Moreover, a computer program for implementing one of the above-described methods when being executed on a computer or signal processor is provided.

BRIEF DESCRIPTION OF THE DRAWINGS

In the following, embodiments of the present invention are described in more detail with reference to the figures, in which.

DETAILED DESCRIPTION OF THE INVENTION

Before describing embodiments of the present invention, more background on state-of-the-art-SAOC systems is provided.

Figure 3:
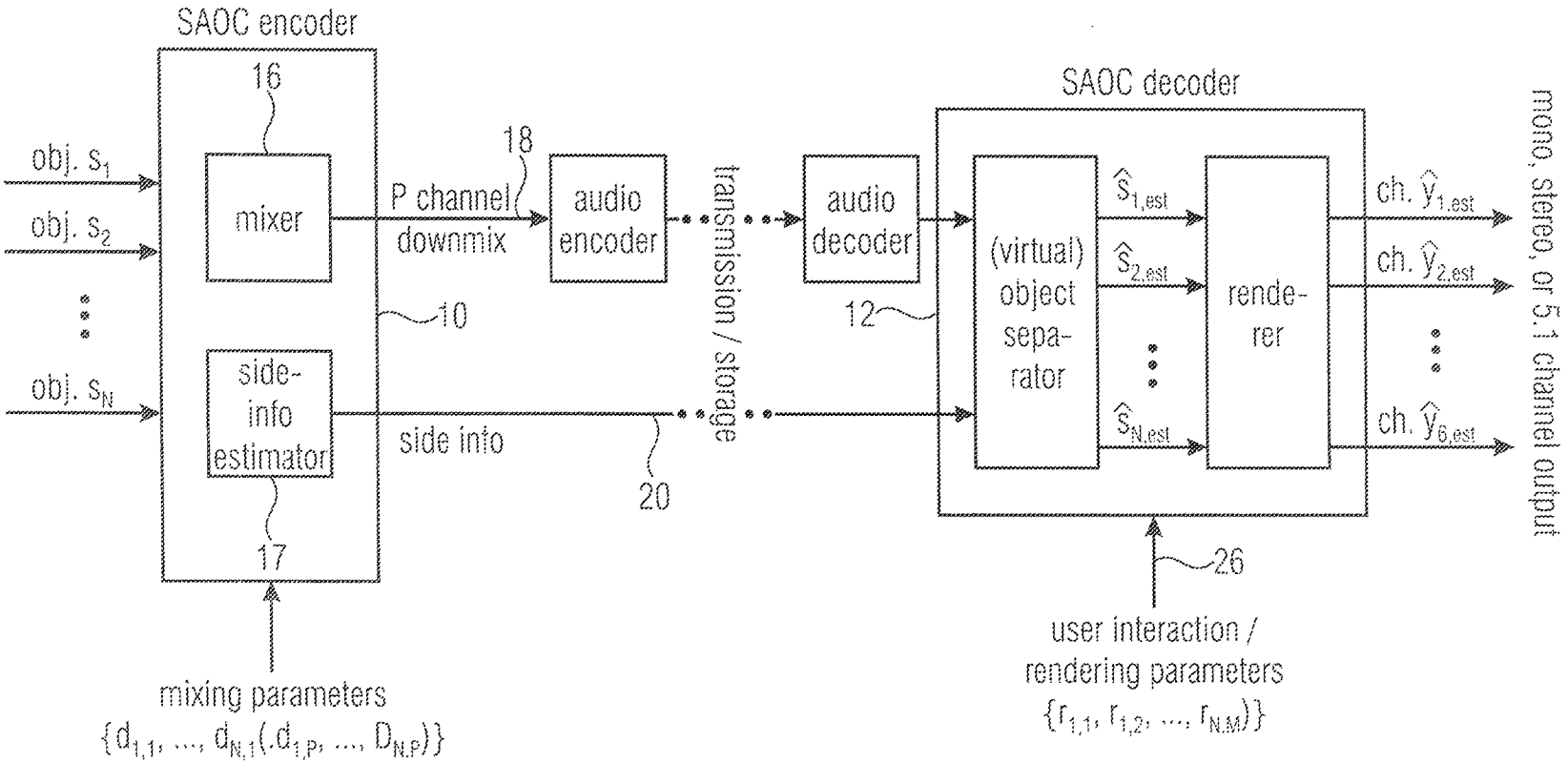
FIG. 3 shows a schematic block diagram of a conceptual overview of an SAOC system.

FIG. 3 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 3, the downmix signal is shown to be a P-channel signal. Thus, any mono (P=1), stereo (P=2) or multi-channel (P>2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_1$ to $s_N$, side-information estimator 17 provides the SAOC decoder 12 with side information including SAOC-parameters. For example, in case of a stereo downmix, the SAOC parameters comprise object level differences (OLD), inter-object correlations (IOC) (inter-object cross correlation parameters), downmix gain values (DMG) and downmix channel level differences (DCLD). The side information 20, including the SAOC-parameters, along with the downmix signal 18, forms the SAOC output data stream received by the SAOC decoder 12.

The SAOC decoder 12 comprises an up-mixer which receives the downmix signal 18 as well as the side information 20 in order to recover and render the audio signals $\hat{s}_1$ and $\hat{s}_N$ onto any user-selected set of channels $\hat{y}_1$ to $\hat{y}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

Figure 4:
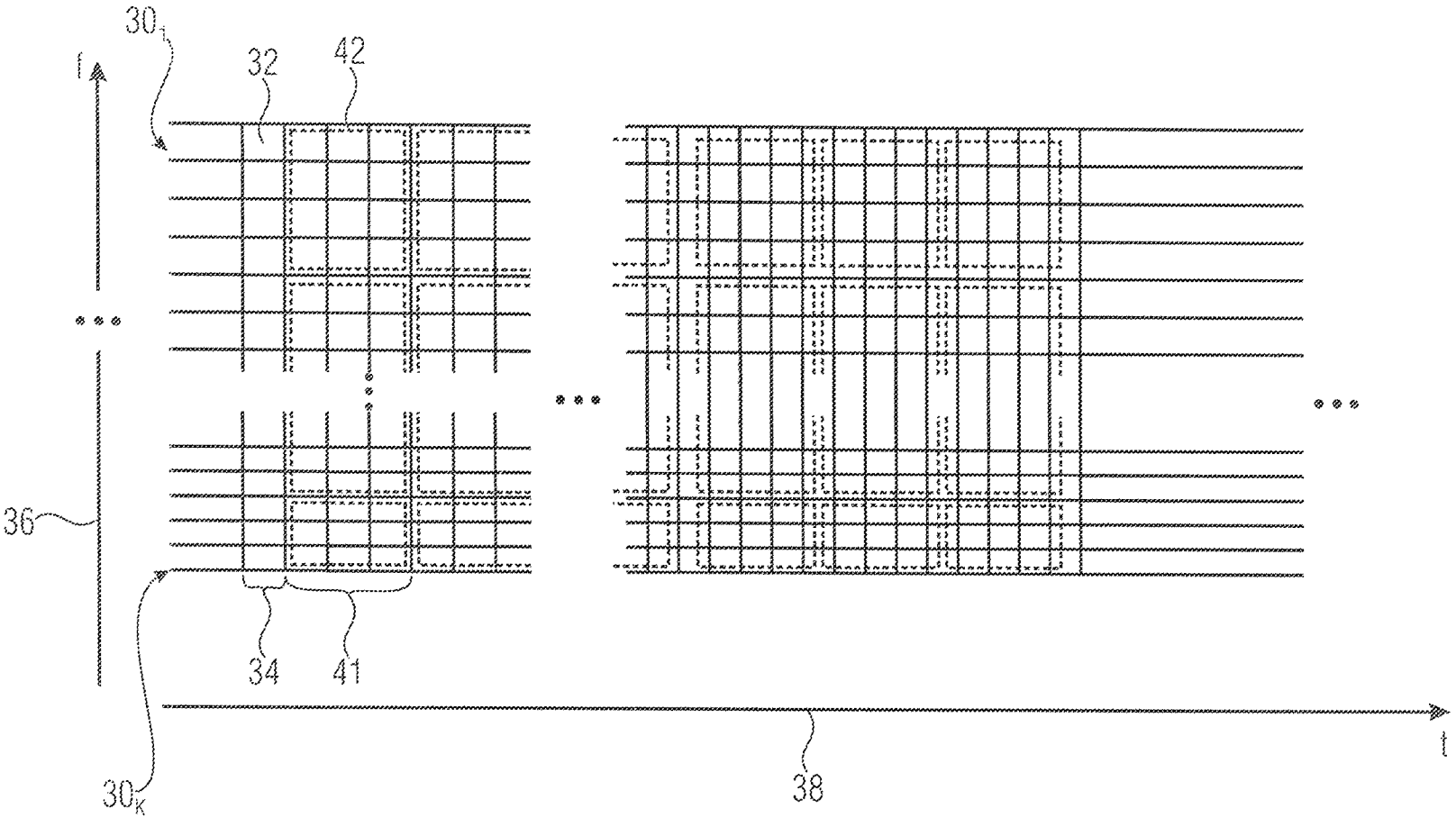
FIG. 4 shows a schematic and illustrative diagram of a temporal-spectral representation of a single-channel audio signal.

FIG. 4 shows an audio signal in the just-mentioned spectral domain. As can be seen, the audio signal is represented as a plurality of sub-band signals. Each sub-band signal $\mathbf{30}_1$ to $\mathbf{30}_K$ consists of a temporal sequence of sub-band values indicated by the small boxes 32. As can be seen, the sub-band values 32 of the sub-band signals $\mathbf{30}_1$ to $\mathbf{30}_K$ are synchronized to each other in time so that, for each of the consecutive filter bank time slots 34, each sub-band $\mathbf{30}_1$ to $\mathbf{30}_K$ comprises exact one sub-band value 32. As illustrated by the frequency axis 36, the sub-band signals $\mathbf{30}_1$ to $\mathbf{30}_K$ are associated with different frequency regions, and as illustrated by the time axis 38, the filter bank time slots 34 are consecutively arranged in time.

As outlined above, side information extractor 17 of FIG. 3 computes SAOC-parameters from the input audio signals $s_1$ to $s_N$. According to the currently implemented SAOC standard, encoder 10 performs this computation in a time/frequency resolution which may be decreased relative to the original time/frequency resolution as determined by the filter bank time slots 34 and sub-band decomposition, by a certain amount, with this certain amount being signaled to the decoder side within the side information 20. Groups of consecutive filter bank time slots 34 may form a SAOC frame 41. Also the number of parameter bands within the SAOC frame 41 is conveyed within the side information 20. Hence, the time/frequency domain is divided into time/frequency tiles exemplified in FIG. 4 by dashed lines 42. In FIG. 4 the parameter bands are distributed in the same manner in the various depicted SAOC frames 41 so that a regular arrangement of time/frequency tiles is obtained. In general, however, the parameter bands may vary from one SAOC frame 41 to the subsequent, depending on the different needs for spectral resolution in the respective SAOC frames 41. Furthermore, the length of the SAOC frames 41 may vary, as well. As a consequence, the arrangement of time/frequency tiles may be irregular. Nevertheless, the time/frequency tiles within a particular SAOC frame 41 typically have the same duration and are aligned in the time direction, i.e., all t/f-tiles in said SAOC frame 41 start at the start of the given SAOC frame 41 and end at the end of said SAOC frame 41.

The side information extractor 17 depicted in FIG. 3 calculates SAOC parameters according to the following formulas. In particular, side information extractor 17 computes object level differences for each object i as $$OLD_i^{l,m} = \frac{\sum_{n\in l}\sum_{k\in m} x_i^{n,k} x_i^{n,k*}}{\max_j\left(\sum_{n\in l}\sum_{k\in m} x_j^{n,k} x_j^{n,k*}\right)}$$

wherein the sums and the indices n and k, respectively, go through all temporal indices 34, and all spectral indices 30 which belong to a certain time/frequency tile 42, referenced by the indices l for the SAOC frame (or processing time slot) and m for the parameter band. Thereby, the energies of all sub-band values $x_i$ of an audio signal or object i are summed up and normalized to the highest energy value of that tile among all objects or audio signals. $x_i^{n,k*}$ denotes the complex conjugate of $x_i^{n,k}$.

Further, the SAOC side information extractor 17 is able to compute a similarity measure of the corresponding time/frequency tiles of pairs of different input objects $s_1$ to $s_N$. Although the SAOC side information extractor 17 may compute the similarity measure between all the pairs of input objects $s_1$ to $s_N$, side information extractor 17 may also suppress the signaling of the similarity measures or restrict the computation of the similarity measures to audio objects $s_1$ to $s_N$ which form left or right channels of a common stereo channel. In any case, the similarity measure is called the inter-object cross-correlation parameter $IOC_{i,j}^{l,m}$. The computation is as follows $$IOC_{i,j}^{l,m} = IOC_{j,i}^{l,m} = Re\left\{\frac{\sum_{n\in l}\sum_{k\in m} x_i^{n,k} x_i^{n,k*}}{\sqrt{\sum_{n\in l}\sum_{k\in m} x_i^{n,k} x_i^{n,k*} \sum_{n\in l}\sum_{k\in m} x_j^{n,k} x_j^{n,k*}}}\right\}$$

with again indices n and k going through all sub-band values belonging to a certain time/frequency tile 42, i and j denoting a certain pair of audio objects $s_1$ to $s_N$, and Re { } denoting the operation of discarding the imaginary part of the complex argument.

The downmixer 16 of FIG. 3 downmixes the objects $s_1$ to $s_N$ by use of gain factors applied to each object $s_1$ to $s_N$. That is, a gain factor $d_i$ is applied to object i and then all thus weighted objects $s_1$ to $s_N$ are summed up to obtain a mono downmix signal, which is exemplified in FIG. 2 if P=1. In another example case of a two-channel downmix signal, depicted in FIG. 3 if P=2, a gain factor $d_{1,i}$ is applied to object i and then all such gain amplified objects are summed in order to obtain the left downmix channel L0, and gain factors $d_{2,i}$ are applied to object i and then the thus gain-amplified objects are summed in order to obtain the right downmix channel R0. A processing that is analogous to the above is to be applied in case of a multi-channel downmix (P>2).

This downmix prescription is signaled to the decoder side by means of downmix gains $DMG_i$ and, in case of a stereo downmix signal, downmix channel level differences $DCLD_i$.

The downmix gains are calculated according to:

$$DMG_i = 20\log_{10}(d_i+\epsilon), \text{ (mono downmix)},$$

$$DMG_i = 10\log_{10}(d_{1,i}^2+d_{2,i}^2+\epsilon), \text{ (stereo downmix)},$$

where $\epsilon$ is a small number such as $10^{-9}$.

For the DCLDs the following formula applies:

$$DCLD_i = 20\log_{10}\left(\frac{d_{1,i}}{d_{2,i}+\varepsilon}\right).$$

In the normal mode, downmixer 16 generates the downmix signal according to:

$$(L0) = (d_i)\begin{pmatrix} s_1 \\ \vdots \\ s_N \end{pmatrix}$$

for a mono downmix, or $$\begin{pmatrix} L0 \\ R0 \end{pmatrix} = \begin{pmatrix} d_{1,i} \\ d_{2,i} \end{pmatrix}\begin{pmatrix} s_1 \\ \vdots \\ s_N \end{pmatrix}$$

for a stereo downmix, respectively.

Thus, in the abovementioned formulas, parameters OLD and IOC are a function of the audio signals and parameters DMG and DCLD are a function of d. By the way, it is noted that d may be varying in time and in frequency.

Thus, in the normal mode, downmixer 16 mixes all objects $s_1$ to $s_N$ with no preferences, i.e., with handling all objects $s_1$ to $s_N$ equally.

At the decoder side, the upmixer performs the inversion of the downmix procedure and the implementation of the "rendering information" 26 represented by a matrix R (in the literature sometimes also called A) in one computation step, namely, in case of a two-channel downmix $$\begin{pmatrix} \hat{y}_1 \\ \vdots \\ \hat{y}_M \end{pmatrix} = RED^*(DED^*)^{-1}\begin{pmatrix} L0 \\ R0 \end{pmatrix},$$

where matrix E is a function of the parameters OLD and IOC, and the matrix D contains the downmixing coefficients as $$D = \begin{pmatrix} d_{1,1} & \dots & d_{1,N} \\ \vdots & \ddots & \vdots \\ d_{P,1} & \dots & d_{P,N} \end{pmatrix}.$$

The matrix E is an estimated covariance matrix of the audio objects $s_1$ to $s_N$. In current SAOC implementations, the computation of the estimated covariance matrix E is typically performed in the spectral/temporal resolution of the SAOC parameters, i.e., for each (l,m), so that the estimated covariance matrix may be written as $E^{l,m}$. The estimated covariance matrix $E^{l,m}$ is of size N×N with its coefficients being defined as $$e_{i,j}^{l,m} = \sqrt{\mathrm{OLD}_i^{l,m}\mathrm{OLD}_j^{l,m}}\,\mathrm{IOC}_{i,j}^{l,m}.$$

Thus, the matrix $E^{l,m}$ with $$E^{l,m} = \begin{pmatrix} e_{1,1}^{l,m} & \dots & e_{1,N}^{l,m} \\ \vdots & \ddots & \vdots \\ e_{N,1}^{l,m} & \dots & e_{N,N}^{l,m} \end{pmatrix}$$

has along its diagonal the object level differences, i.e., $e_{i,j}^{l,m} = \mathrm{OLD}_i^{l,m}$ for i=j, since $\mathrm{OLD}_i^{l,m} = \mathrm{OLD}_j^{l,m}$ and $\mathrm{IOC}_{i,j}^{l,m} = 1$ for i=j. Outside its diagonal the estimated covariance matrix E has matrix coefficients representing the geometric mean of the object level differences of objects i and j, respectively, weighted with the inter-object cross correlation measure $\mathrm{IOC}_{i,j}^{l,m}$.

Figure 5:
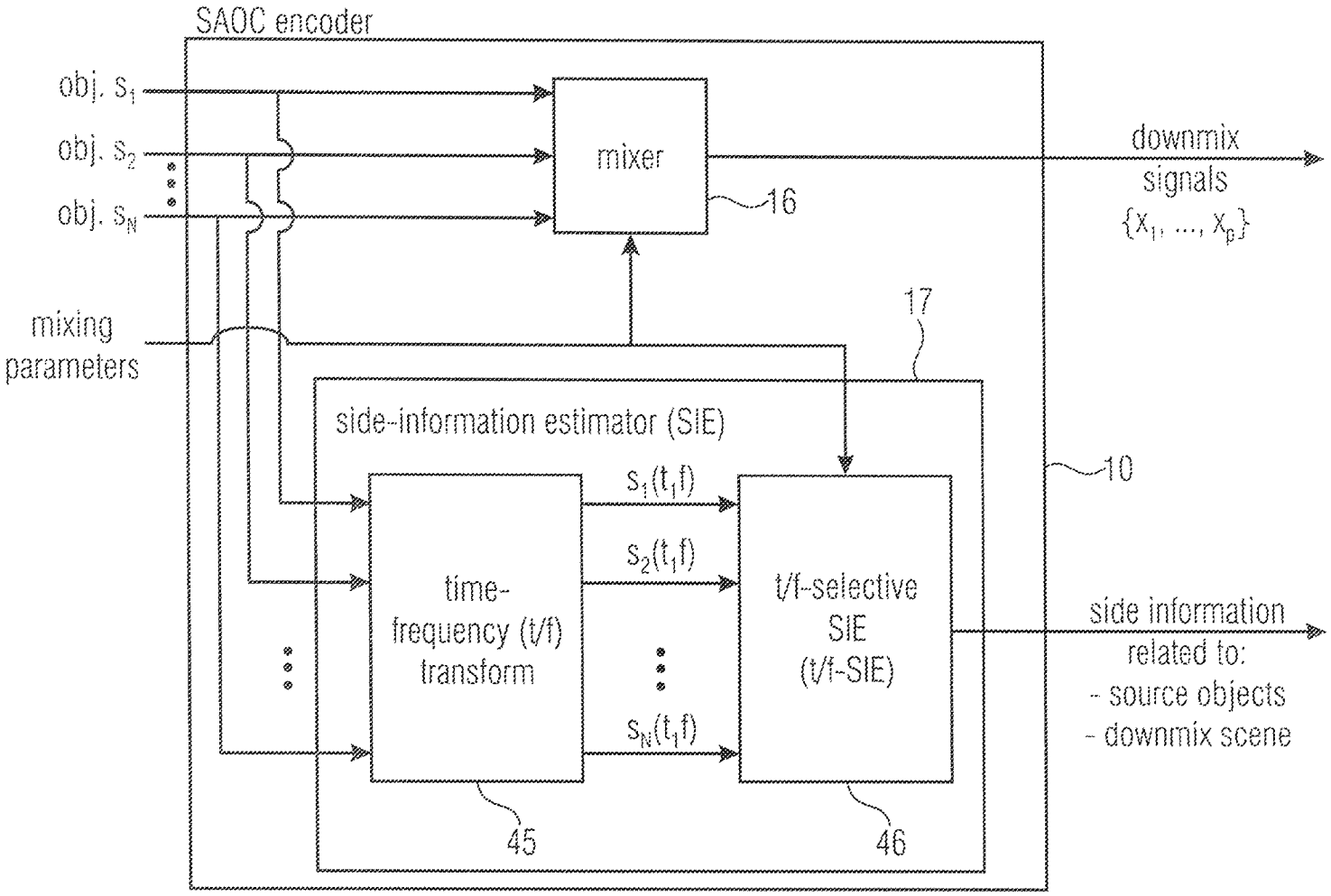
FIG. 5 shows a schematic block diagram of a time-frequency selective computation of side information within an SAOC encoder.

FIG. 5 displays one possible principle of implementation on the example of the Side-information estimator (SIE) as part of a SAOC encoder 10. The SAOC encoder 10 comprises the mixer 16 and the side-information estimator (SIE) 17. The SIE conceptually consists of two modules: One module 45 to compute a short-time based t/f-representation (e.g., STFT or QMF) of each signal. The computed short-time t/f-representation is fed into the second module 46, the t/f-selective-Side-Information-Estimation module (t/f-SIE). The t/f-SIE module 46 computes the side information for each t/f-tile. In current SAOC implementations, the time/frequency transform is fixed and identical for all audio objects $s_1$ to $s_N$. Furthermore, the SAOC parameters are determined over SAOC frames which are the same for all audio objects and have the same time/frequency resolution for all audio objects $s_1$ to $s_N$, thus disregarding the object-specific needs for fine temporal resolution in some cases or fine spectral resolution in other cases.

In the following, embodiments of the present invention are described.

Figure 1A:
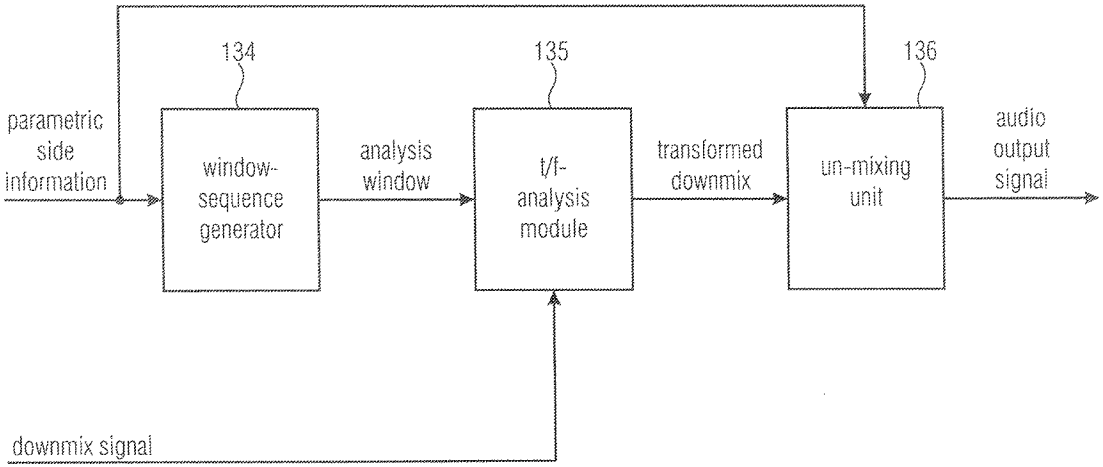
FIG. 1*a* illustrates a decoder according to an embodiment.

FIG. 1*a* illustrates a decoder for generating an audio output signal comprising one or more audio output channels from a downmix signal comprising a plurality of time-domain downmix samples according to an embodiment. The downmix signal encodes two or more audio object signals.

The decoder comprises a window-sequence generator 134 for determining a plurality of analysis windows (e.g., based on parametric side information, e.g., object level differences), wherein each of the analysis windows comprises a plurality of time-domain downmix samples of the downmix signal. Each analysis window of the plurality of analysis windows has a window length indicating the number of the time-domain downmix samples of said analysis window. The window-sequence generator 134 is configured to determine the plurality of analysis windows so that the window length of each of the analysis windows depends on a signal property of at least one of the two or more audio object signals. For example, the window length may depend on whether said analysis window comprises a transient, indicating a signal change of at least one of the two or more audio object signals being encoded by the downmix signal.

For determining the plurality of analysis windows, the window-sequence generator 134 may, for example, analyse parametric side information, e.g., transmitted object level differences relating to the two or more audio object signals, to determine the window length of the analysis windows, so that the window length of each of the analysis windows depends on a signal property of at least one of the two or more audio object signals. Or, for example, for determining the plurality of analysis windows, the window-sequence generator 134 may analyse the window shapes or the analysis windows themselves, wherein the window shapes or the analysis windows may, e.g., be transmitted in the bitstream from the encoder to the decoder, and wherein the window length of each of the analysis windows depends on a signal property of at least one of the two or more audio object signals.

Moreover, the decoder comprises a t/f-analysis module 135 for transforming the plurality of time-domain downmix samples of each analysis window of the plurality of analysis windows from a time-domain to a time-frequency domain depending on the window length of said analysis window, to obtain a transformed downmix.

Furthermore, the decoder comprises an un-mixing unit 136 for un-mixing the transformed downmix based on parametric side information on the two or more audio object signals to obtain the audio output signal.

The following embodiments use a special window sequence construction mechanism. A prototype window function $f(n, N_w)$ is defined for the index $0 \le n \le N_w - 1$ for a window length $N_w$. Designing a single window $w_k(n)$, three control points are needed, namely the centres of the previous, current, and the next window, $c_{k-1}$, $c_k$, and $c_{k+1}$.

Using them, the windowing function is defined as $$w_k(n) = \begin{cases} f(n, 2(c_k - c_{k-1})), & \text{for } 0 \le n < c_k - c_{k-1} \\ f\left(\dfrac{n - 2c_k + c_{k-1} + c_{k+1}}{2(c_{k+1} - c_k)}\right), & \text{for } c_k - c_{k-1} \le n < c_{k+1} - c_{k-1}. \end{cases}$$

The actual window location is then $\lceil c_{k-1} \rceil \le m \le \lfloor c_{k+1} \rfloor$ with $n = m - \lceil c_{k-1} \rceil$ ($\lceil\ \rceil$ denotes the operation of rounding the argument to the next integer up, and $\lfloor\ \rfloor$ denotes correspondingly the operation of rounding the argument to the next integer down). The prototype window function used in the illustrations is sinusoidal window defined as $$f(n, N) = \sin\left(\frac{\pi(2n+1)}{2N}\right),$$

but also other forms can be used. The transient location t defines the centers for three windows $c_{k-1} = t - l_b$, $c_k = t$, and $c_{k+1} = t + l_a$, where the numbers $l_b$ and $l_a$ define the desired window range before and after the transient.

As explained later with respect to FIG. 9, the window-sequence generator 134 may, for example, be configured to determine the plurality of analysis windows, so that a transient is comprised by a first analysis window of the plurality of analysis windows and by a second analysis window of the plurality of analysis windows, wherein a center $c_k$ of the first analysis window is defined by a location t of the transient according to $c_k = t - l_b$, and a center $c_{k+1}$ of the first analysis window is defined by the location t of the transient according to $c_{k+1} = t + l_a$, wherein $l_a$ and $l_b$ are numbers.

As explained later with respect to FIG. 10, the window-sequence generator 134 may, for example, be configured to determine the plurality of analysis windows, so that a transient is comprised by a first analysis window of the plurality of analysis windows, wherein a center $c_k$ of the first analysis window is defined by a location t of the transient according to $c_k = t$, wherein a center $c_{k-1}$ of a second analysis window of the plurality of analysis windows is defined by a location t of the transient according to $c_{k-1} = t - l_b$, and wherein a center $c_{k+1}$ of a third analysis window of the plurality of analysis windows is defined by a location t of the transient according to $c_{k+1} = t + l_a$, wherein $l_a$ and $l_b$ are numbers.

As explained later with respect to FIG. 11, the window-sequence generator 134 may, for example, be configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient.

In an embodiment, the t/f-analysis module 135 is configured to transform the time-domain downmix samples of each of the analysis windows from a time-domain to a time-frequency domain by employing a QMF filter bank and a Nyquist filter bank, wherein the t/f-analysis unit (135) is configured to transform the plurality of time-domain signal samples of each of the analysis windows depending on the window length of said analysis window.

Figure 2A:
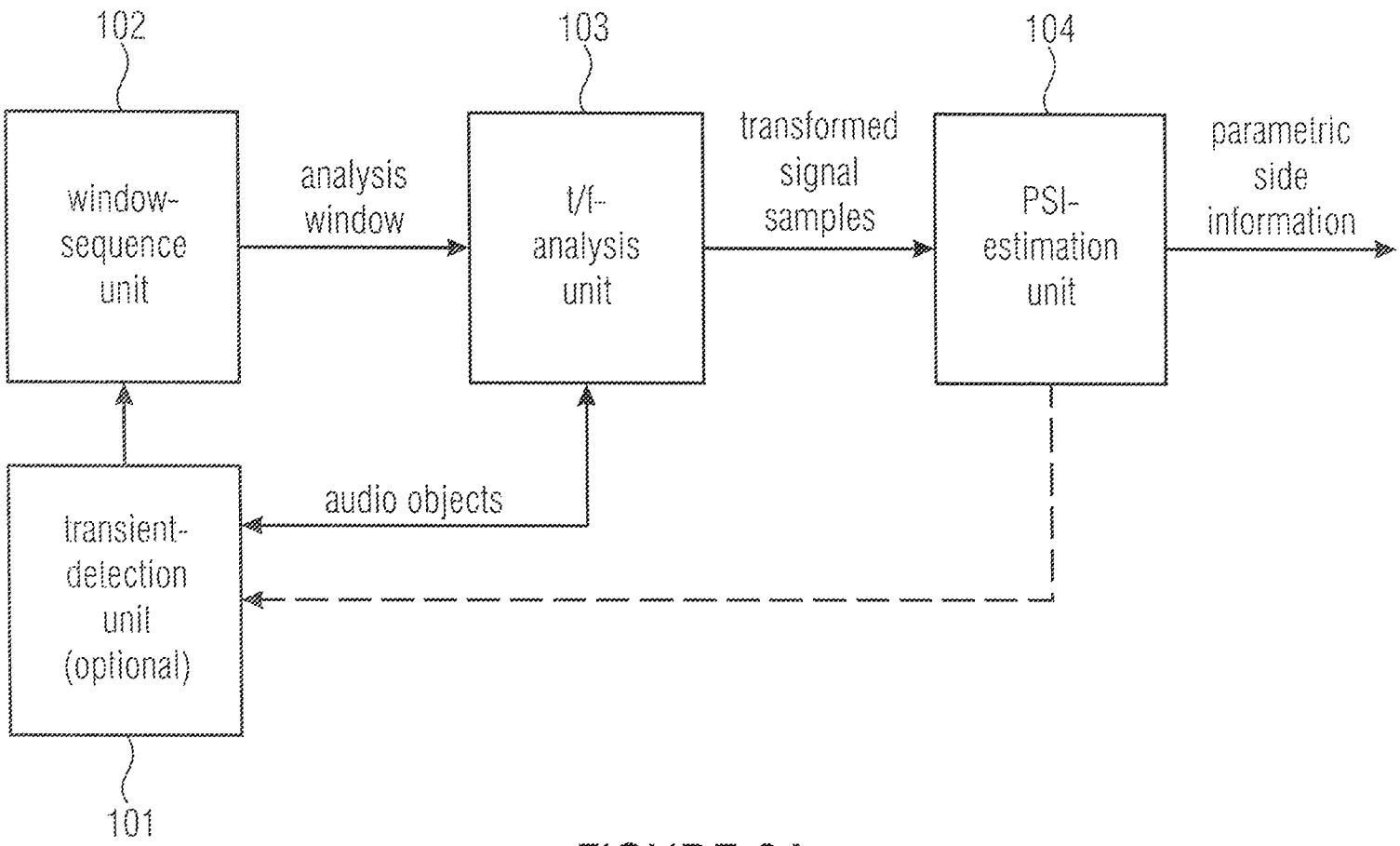
FIG. 2*a* illustrates an encoder for encoding input audio object signals according to an embodiment.

FIG. 2*a* illustrates an encoder for encoding two or more input audio object signals. Each of the two or more input audio object signals comprises a plurality of time-domain signal samples.

The encoder comprises a window-sequence unit 102 for determining a plurality of analysis windows. Each of the analysis windows comprises a plurality of the time-domain signal samples of one of the input audio object signals, wherein each of the analysis windows has a window length indicating the number of time-domain signal samples of said analysis window. The window-sequence unit 102 is configured to determine the plurality of analysis windows so that the window length of each of the analysis windows depends on a signal property of at least one of the two or more input audio object signals. For example, the window length may depend on whether said analysis window comprises a transient, indicating a signal change of at least one of the two or more input audio object signals.

Moreover, the encoder comprises a t/f-analysis unit 103 for transforming the time-domain signal samples of each of the analysis windows from a time-domain to a time-frequency domain to obtain transformed signal samples. The t/f-analysis unit 103 may be configured to transform the plurality of time-domain signal samples of each of the analysis windows depending on the window length of said analysis window.

Furthermore, the encoder comprises PSI-estimation unit 104 for determining parametric side information depending on the transformed signal samples.

In an embodiment, the encoder may, e.g., further comprise a transient-detection unit 101 being configured to determine a plurality of object level differences of the two or more input audio object signals, and being configured to determine, whether a difference between a first one of the object level differences and a second one of object level differences is greater than a threshold value, to determine for each of the analysis windows, whether said analysis window comprises a transient, indicating a signal change of at least one of the two or more input audio object signals.

According to an embodiment, the transient-detection unit 101 is configured to employ a detection function d(n) to determine whether the difference between the first one of the object level differences and the second one of object level differences is greater than the threshold value, wherein the detection function d(n) is defined as:

$$d(n) = \sum_{i,j} |\log(OLD_{i,j}(b, n-1)) - \log(OLD_{i,j}(b, n))|$$

wherein n indicates a temporal index, wherein i indicates a first object, wherein j indicates a second object, wherein b indicates a parametric band. OLD may, for example, indicate an object level difference.

As explained later with respect to FIG. 9, the window-sequence unit 102 may, for example, be configured to determine the plurality of analysis windows, so that a transient, indicating a signal change of at least one of the two or more input audio object signals, is comprised by a first analysis window of the plurality of analysis windows and by a second analysis window of the plurality of analysis windows, wherein a center $c_k$ of the first analysis window is defined by a location t of the transient according to $c_k=t-l_b$, and a center $c_{k+1}$ of the first analysis window is defined by the location t of the transient according to $c_{k+1}=t+l_a$, wherein $l_a$ and $l_b$ are numbers.

As explained later with respect to FIG. 10, the window-sequence unit 102 may, for example, be configured to determine the plurality of analysis windows, so that a transient, indicating a signal change of at least one of the two or more input audio object signals, is comprised by a first analysis window of the plurality of analysis windows, wherein a center $c_k$ of the first analysis window is defined by a location t of the transient according to $c_k=t$, wherein a center $c_{k-1}$ of a second analysis window of the plurality of analysis windows is defined by a location t of the transient according to $c_{k-1}=t-l_b$, and wherein a center $c_{k+1}$ of a third analysis window of the plurality of analysis windows is defined by a location t of the transient according to $c_{k+1}=t+l_a$, wherein $l_a$ and $l_b$ are numbers.

As explained later with respect to FIG. 11, the window-sequence unit 102 may, for example, be configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient, indicating a signal change of at least one of the two or more input audio object signals.

According to an embodiment, the t/f-analysis unit 103 is configured to transform the time-domain signal samples of each of the analysis windows from a time-domain to a time-frequency domain by employing a QMF filter bank and a Nyquist filter bank, wherein the t/f-analysis unit 103 is configured to transform the plurality of time-domain signal samples of each of the analysis windows depending on the window length of said analysis window.

In the following, enhanced SAOC using backward compatible adaptive filter banks according to embodiments is described.

At first, decoding of standard SAOC bit streams by an enhanced SAOC decoder is explained.

The enhanced SAOC decoder is designed so that it is capable decoding bit streams from standard SAOC encoders with a good quality. The decoding is limited to the parametric reconstruction only, and possible residual streams are ignored.

Figure 6:
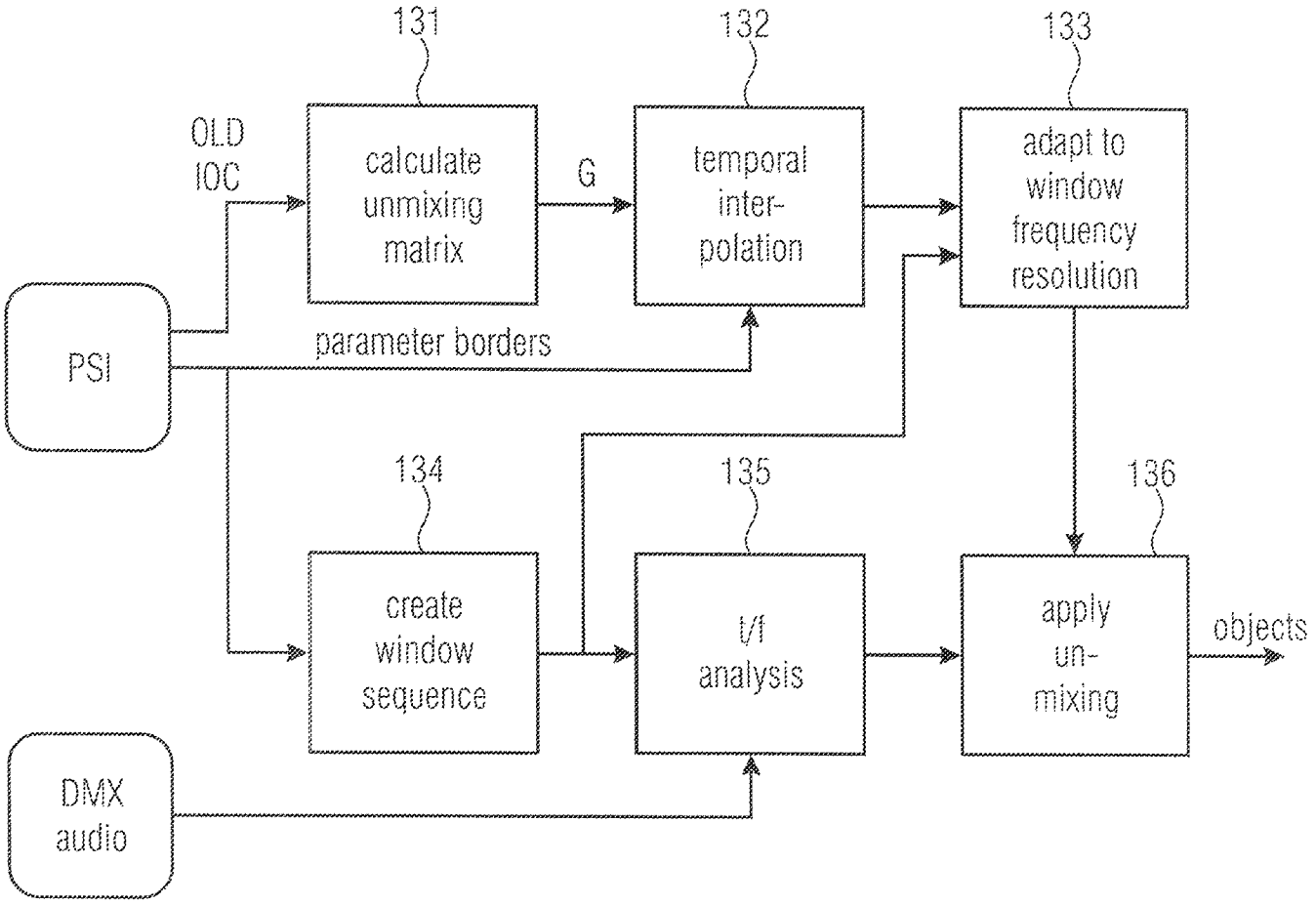
FIG. 6 depicts a block diagram of an enhanced SAOC decoder according to an embodiment, illustrating decoding standard SAOC bit streams.

FIG. 6 depicts a block diagram of an enhanced SAOC decoder according to an embodiment, illustrating decoding standard SAOC bit streams. Bold black functional blocks (132, 133, 134, 135) indicate the inventive processing. The parametric side information (PSI) consists of sets of object level differences (OLD), inter-object correlations (IOC), and a downmix matrix D used to create the downmix signal (DMX audio) from the individual objects in the decoder. Each parameter set is associated with a parameter border which defines the temporal region to which the parameters are associated to. In standard SAOC, the frequency bins of the underlying time/frequency-representation are grouped into parametric bands. The spacing of the bands resembles that of the critical bands in the human auditory system. Furthermore, multiple t/f-representation frames can be grouped into a parameter frame. Both of these operations provide a reduction in the amount of necessitated side information with the cost of modelling inaccuracies.

As described in the SAOC standard, the OLDs and IOCs are used to calculate the un-mixing matrix $G=ED^TJ$, where the elements of E are $E(i,j)=IOC_{i,j}\sqrt{OLD_iOLD_j}$ approximates the object cross-correlation matrix, i and j are object indices, $J\approx(DED^T)^{-1}$, and $D^T$ is the transpose of D. An un-mixing-matrix calculator 131 may be configured to calculate the un-mix matrix accordingly.

The un-mixing matrix is then linearly interpolated by a temporal interpolator 132 from the un-mixing matrix of the preceding frame over the parameter frame up to the parameter border on which the estimated values are reached, as per standard SAOC. This results into un-mixing matrices for each time/frequency-analysis window and parametric band.

The parametric band frequency resolution of the un-mixing matrices is expanded to the resolution of the time-frequency representation in that analysis window by a window-frequency-resolution-adaptation unit 133. When the interpolated un-mixing matrix for parametric band b in a time-frame is defined as G(b), the same un-mixing coefficients are used for all the frequency bins inside that parametric band.

A window-sequence generator 134 is configured to use the parameter set range information from the PSI to determine an appropriate windowing sequence for analyzing the input downmix audio signal. The main requirement is that when there is a parameter set border in the PSI, the cross-over point between consecutive analysis windows should match it. The windowing determines also the frequency resolution of the data within each window (used in the un-mixing data expansion, as described earlier).

The windowed data is then transformed by the t/f-analysis module 135 into a frequency domain representation using an appropriate time-frequency transform, e.g., Discrete Fourier Transform (DFT), Complex Modified Discrete Cosine Transform (CMDCT), or Oddly stacked Discrete Fourier Transform (ODFT).

Finally, an un-mixing unit 136 applies the per-frame per-frequency bin un-mixing matrices on the spectral representation of the downmix signal X to obtain the parametric reconstructions Y. The output channel j is a linear combination of the downmix channels $$Y_j = \sum_i G_{j,i} X_i.$$

The quality that can be obtained with this process is for most of the purposes perceptually indistinguishable from the result obtained with a standard SAOC decoder.

It should be noted that the above text describes reconstruction of individual objects, but in standard SAOC the rendering is included in the un-mixing matrix, i.e., it is included in parametric interpolation. As a linear operation, the order of the operations does not matter, but the difference is worth noting.

In the following, decoding of enhanced SAOC bit streams by an enhanced SAOC decoder is described.

The main functionality of the enhanced SAOC decoder is already described earlier in decoding of standard SAOC bit streams. This section will detail how the introduced enhanced SAOC enhancements in the PSI can be used for obtaining a better perceptual quality.

Figure 7:
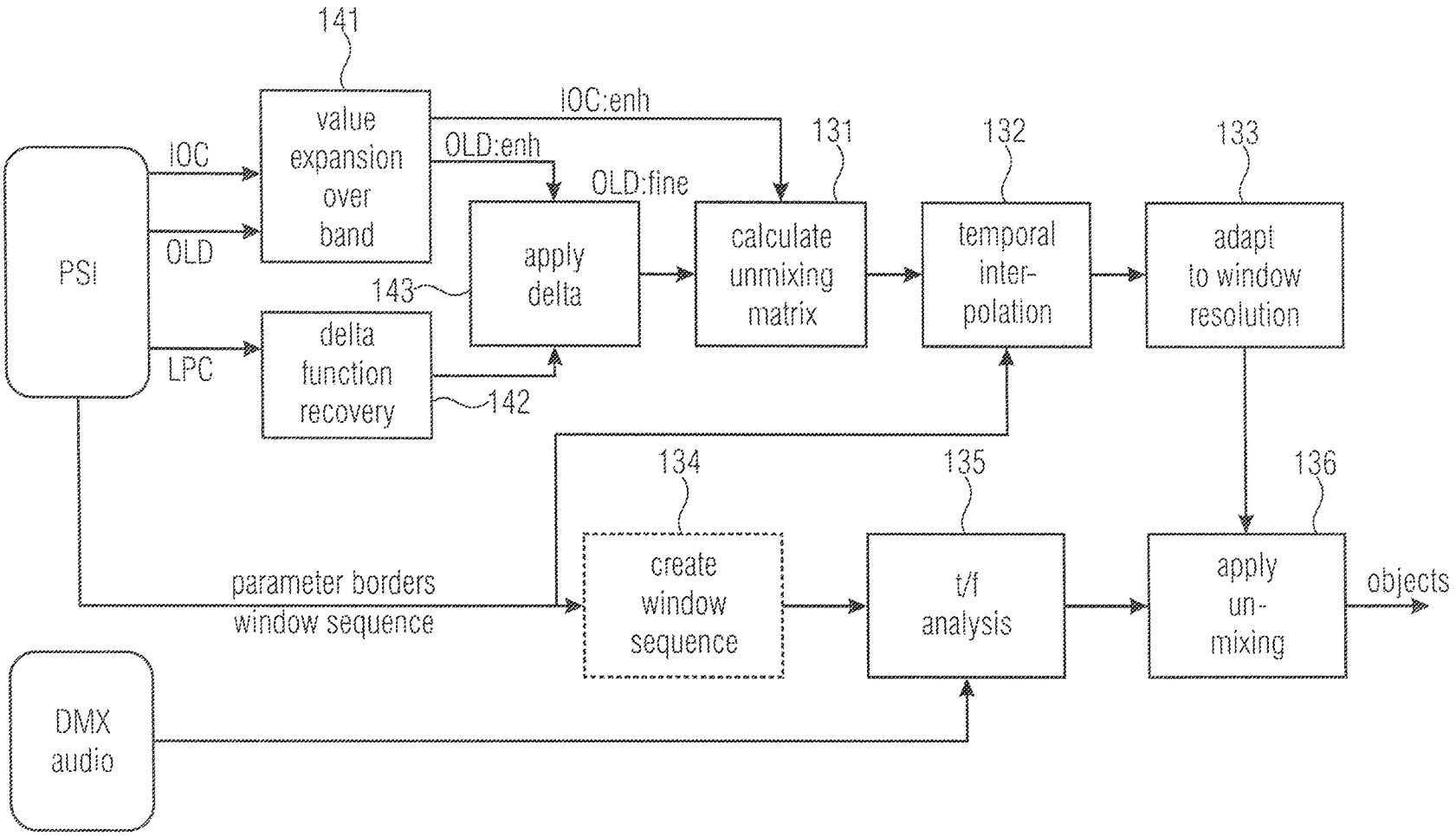
FIG. 7 depicts a block diagram of a decoder according to an embodiment.

FIG. 7 depicts the main functional blocks of the decoder according to an embodiment illustrating the decoding of the frequency resolution enhancements. Bold black functional blocks (132, 133, 134, 135) indicate the inventive processing.

At first, a value-expand-over-band unit 141 adapts the OLD and IOC values for each parametric band to the frequency resolution used in the enhancements, e.g., to 1024 bins. This is done by replicating the value over the frequency bins that correspond to the parametric band. This results into new OLDs $OLD_i^{enh}(f)=K(f,b)OLD_i(b)$ and IOCs $IOC_{i,j}^{enh}(f)=K(f,b)IOC_{i,j}(b)$. K(f,b) is a kernel matrix defining the assignment of frequency bins f into parametric bands b by $$K(f,b)=\begin{cases}1, & \text{if } f\in b\\ 0, & \text{otherwise}\end{cases}.$$

Parallel to this, the delta-function-recovery unit 142 inverts the correction factor parameterization to obtain the delta function $C_i^{rec}(f)$ of the same size as the expanded OLD and IOC.

Then, the delta-application unit 143 applies the delta on the expanded OLD-values, and the obtained fine resolution OLD-values are obtained by $OLD_i^{fine}(f)=\hat{C}_i(f)OLD_i^{enh}(f)$.

In a particular embodiment, the calculation of un-mixing matrices, may, for example, be done by the un-mixing-matrix calculator 131 as with decoding standard SAOC bit stream: $G(f)=E(f)D^T(f)J(f)$, with $E_{i,j}(f)=IOC_{i,j}^{enh}(f)\sqrt{OLD_i^{fine}(f)OLD_j^{fine}(f)}$, and $J(f)\approx(D(f)E(f)D^T(f))^{-1}$. If wanted, the rendering matrix can be multiplied into the un-mixing matrix G(f). The temporal interpolation by the temporal interpolator 132 follows as per the standard SAOC.

As the frequency resolution in each window may be different (usually lower) from the nominal high frequency resolution, the window-frequency-resolution-adaptation unit 133 need to adapt the un-mixing matrices to match the resolution of the spectral data from audio to allow applying it. This can be made, e.g., by resampling the coefficients over the frequency axis to the correct resolution. Or if the resolutions are integer multiples, simply averaging from the high-resolution data the indices that correspond to one frequency bin in the lower resolution $$G^{low}(b)=1/\|b\|\sum_{f\in b}G(f).$$

The windowing sequence information from the bit stream can be used to obtain a fully complementary time-frequency analysis to the one used in the encoder, or the windowing sequence can be constructed based on the parameter borders, as is done in the standard SAOC bit stream decoding. For this, a window-sequence generator 134 may be employed.

The time-frequency analysis of the downmix audio is then conducted by a t/f-analysis module 135 using the given windows.

Finally, the temporally interpolated and spectrally (possibly) adapted un-mixing matrices are applied by an un-mixing unit 136 on the time-frequency representation of the input audio, and the output channel j can be obtained as a linear combination of the input channels $$Y_j(f)=\sum_i G_{j,i}^{low}(f)X_i(f).$$

In the following, backward compatible enhanced SAOC encoding is described.

Now, an enhanced SAOC encoder which produces a bit stream containing a backward compatible side information portion and additional enhancements is described. The existing standard SAOC decoders can decode the backward compatible portion of the PSI and produce reconstructions of the objects. The added information used by the enhanced SAOC decoder improves the perceptual quality of the reconstructions in most of the cases. Additionally, if the enhanced SAOC decoder is running on limited resources, the enhancements can be ignored and a basic quality reconstruction is still obtained. It should be noted that the reconstructions from standard SAOC and enhanced SAOC decoders using only the standard SAOC compatible PSI differ, but are judged to be perceptually very similar (the difference is of the similar nature as in decoding standard SAOC bit streams with an enhanced SAOC decoder).

Figure 8:
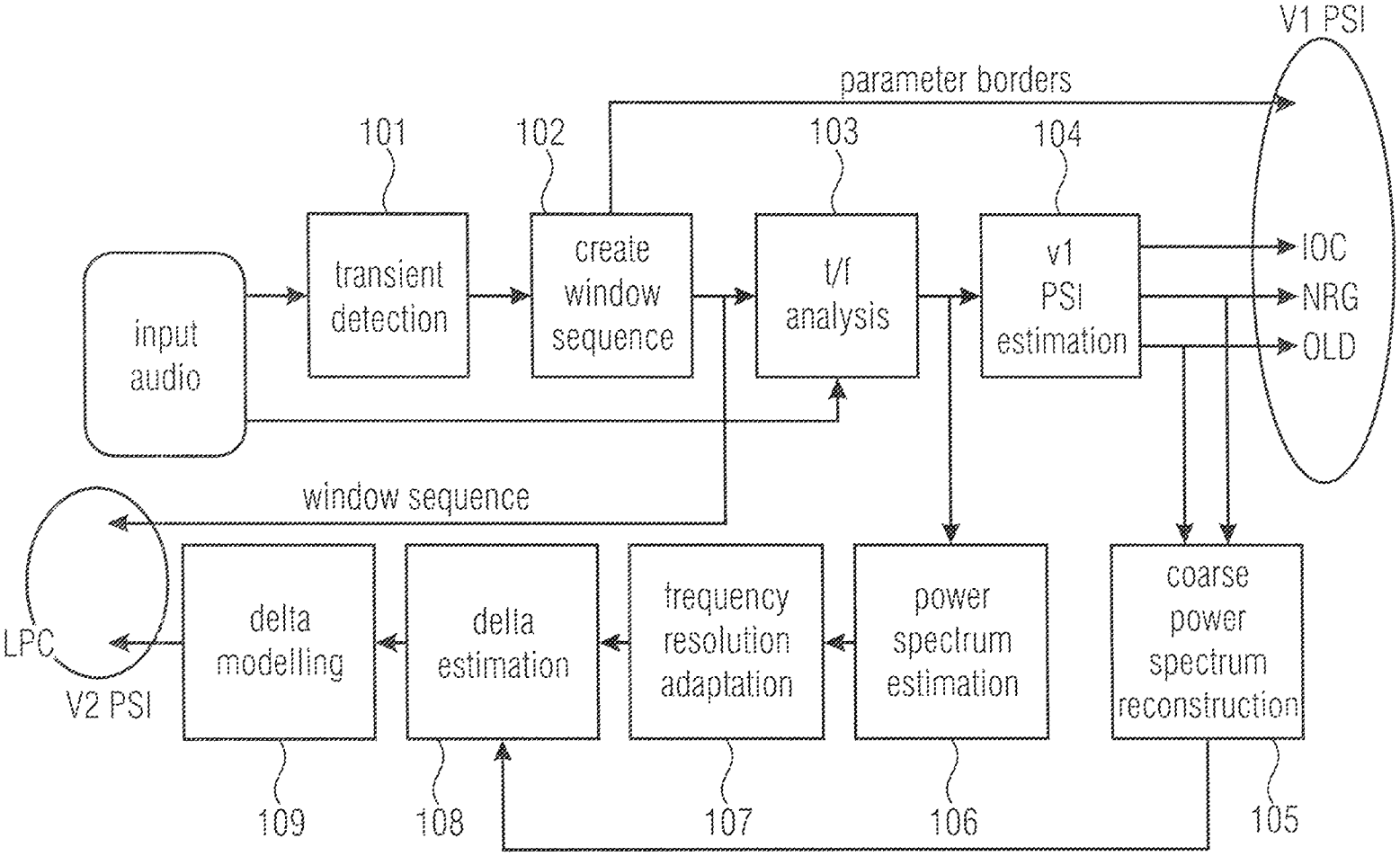
FIG. 8 illustrates a block diagram of an encoder according to a particular embodiment implementing a parametric path of an encoder.

FIG. 8 illustrates a block diagram of an encoder according to a particular embodiment implementing the parametric path of the encoder described above. Bold black functional blocks (102, 103) indicate the inventive processing. In particular, FIG. 8 illustrates a block diagram of two-stage encoding producing backward-compatible bit stream with enhancements for more capable decoders.

First, the signal is subdivided into analysis frames, which are then transformed into the frequency-domain. Multiple analysis frames are grouped into a fixed-length parameter frame using, e.g., in MPEG SAOC lengths of 16 and 32 analysis frames are common. It is assumed that the signal properties remain quasi-stationary during the parameter frame and can thus be characterized with only one set of parameters. If the signal characteristics change within the parameter frame, modelling error is suffered, and it would be beneficial in sub-dividing the longer parameter frame into parts in which the assumption of quasi-stationary is again fulfilled. For this purpose, transient detection is needed.

The transients may be detected by the transient-detection unit 101 from all input objects separately, and when there is a transient event in only one of the objects that location is declared as a global transient location. The information of the transient locations is used for constructing an appropriate windowing sequence. The construction can be based, for example, on the following logic:

- Set a default window length, i.e., the length of a default signal transform block, e.g., 2048 samples.
- Set parameter frame length, e.g., 4096 samples, corresponding to 4 default windows with 50% overlap. Parameter frames group multiple windows together and a single set of signal descriptors are used for the entire block instead of having descriptors for each window separately. This allows reducing the amount of PSI.
- If no transient has been detected, use the default windows and the full parameter frame length.
- If a transient is detected, adapt the windowing to provide a better temporal resolution at the location of the transient.

While constructing the windowing sequence, the window-sequence unit 102 responsible for it also creates parameter sub-frames from one or more analysis windows. Each subset is analyzed as an entity and only one set of PSI-parameters are transmitted for each sub-block. To provide a standard SAOC compatible PSI, the defined parameter block length is used as the main parameter block length, and the possible located transients within that block define parameter subsets.

The constructed window sequence is outputted for time-frequency analysis of the input audio signals conducted by the t/f-analysis unit 103, and transmitted in the enhanced SAOC enhancement portion of the PSI.

The spectral data of each analysis window is used by the PSI-estimation unit 104 for estimating the PSI for the backwards compatible (e.g., MPEG) SAOC part. This is done by grouping the spectral bins into parametric bands of MPEG SAOC and estimating the IOCs, OLDs and absolute objects energies (NRG) in the bands. Following loosely the notation of MPEG SAOC, the normalized product of two object spectra $S_i(f,n)$ and $S_j(f,n)$ in a parameterization tile is defined as $$nrg_{i,j}(b) = \frac{\sum_{n=0}^{N-1} \sum_{f=0}^{F_n-1} K(b, f, n) S_i(f, n) S_j^*(f, n)}{\sum_{n=0}^{N-1} \sum_{f=0}^{F_n-1} K(b, f, n)},$$

where the matrix $K(b, f, n):\mathbb{R}^{B \times F_n \times N}$ defines the mapping from the $F_n$ t/f-representation bins in frame n (of the N frames in this parameter frame) into parametric B bands by $$K(b, f, n) = \begin{cases} 1, & \text{if } f \in b \\ 0, & \text{otherwise} \end{cases},$$

and

S* is the complex conjugate of S. The spectral resolution can vary between the frames within a single parametric block, so the mapping matrix converts the data into a common resolution basis. The maximum object energy in this parameterization tile is defined to be the maximum object energy $NRG(b)=\max(nrg_{i,i}(b))$. Having this value, the OLDs are then defined to be the normalized object energies $$OLD_i(b) = \frac{nrg_{i,i}(b)}{NRG(b)}.$$

And finally the IOC can be obtained from the cross-powers as $$IOC_{i,j}(b) = Re\left\{\frac{nrg_{i,j}(b)}{\sqrt{nrg_{i,i}(b) nrg_{j,j}(b)}}\right\}.$$

This concludes the estimation of the standard SAOC compatible parts of the bit stream.

A coarse-power-spectrum-reconstruction unit 105 is configured to use the OLDs and NRGs for reconstructing a rough estimate of the spectral envelope in the parameter analysis block. The envelope is constructed in the highest frequency resolution used in that block.

The original spectrum of each analysis window is used by a power-spectrum-estimation unit 106 for calculating the power spectrum in that window.

The obtained power spectra are transformed into a common high frequency resolution representation by a frequency-resolution-adaptation unit 107. This can be done, for example, by interpolating the power spectral values. Then the mean power spectral profile is calculated by averaging the spectra within the parameter block. This corresponds roughly to OLD-estimation omitting the parametric band aggregation. The obtained spectral profile is considered as the fine-resolution OLD.

The delta-estimation unit 108 is configured to estimate a correction factor, "delta", e.g., by dividing the fine-resolution OLD by the rough power spectrum reconstruction. As a result, this provides for each frequency bin a (multiplicative) correction factor that can be used for approximating the fine-resolution OLD given the rough spectra.

Finally, a delta-modelling unit 109 is configured to model the estimated correction factor in an efficient way for transmission.

Effectively, the enhanced SAOC modifications to the bit stream consist of the windowing sequence information and the parameters for transmitting the "delta".

In the following, transient detection is described.

When the signal characteristics remain quasi-stationary, coding gain (with respect to amount of side information) can be obtained by combining several temporal frames into parameter blocks. For example, in standard SAOC, often used values are 16 and 32 QMF-frames per one parameter block. These correspond to 1024 and 2048 samples, respectively. The length of the parameter block can be set in advance to a fixed value. The one direct effect it has, is the codec delay (the encoder need have a full frame to be able to encode it). When using long parametric blocks, it would be beneficial to detect significant changes in the signal characteristics, essentially when the quasi-stationary assumption is violated. After finding a location of a significant change, the time-domain signal can be divided there and the parts may again fulfil the quasi-stationary assumption better.

Here, a novel transient detection method is described to be used in conjunction with SAOC. Pedantic seen, it does not aim at detecting transients, but instead of changes in the signal parameterizations which can be triggered also, e.g., by a sound offset.

The input signal is divided into short, overlapping frames, and the frames are transformed into frequency-domain, e.g., with the Discrete Fourier Transform (DFT). The complex spectrum is transformed into power spectrum by multiplying the values with their complex conjugates (i.e., squaring their absolute values). Then a parametric band grouping, similar to the one used in standard SAOC, is used, and the energy of each parametric band in each time frame in each object is calculated. The operations are in short $$P_i(b, n) = \sum_{f \in b} S_i(f, n) S_i^*(f, n),$$

where $S_i(f, n)$ is the complex spectrum of the object i in the time-frame n. The summation runs over the frequency bins f in the band b. To remove some noise effect from the data, the values are low-pass filtered with a first-order IIR-filter:

$$P_i^{LP}(b,n) = a_{LP} P_i^{LP}(b,n-1) + (1-a_{LP}) P_i(b,n),$$

where $0 \leq a_{LP} \leq 1$ is the filter feed-back coefficient, e.g., $a_{LP}=0.9$.

The main parameterization in SAOC are the object level differences (OLDs). The proposed detection method attempts to detect when the OLDs would change. Thus, all object pairs are inspected with $OLD_{i,j}(b,n)=P_i^{LP}(b,n)/P_j^{LP}(b,n)$. The changes in all unique object pairs are summed into a detection function by $$d(n) = \sum_{i,j} |\log(OLD_{i,j}(b, n-1)) - \log(OLD_{i,j}(b, n))|.$$

The obtained values are compared to a threshold T to filter small level deviations out, and a minimum distance L between consecutive detections is enforced. Thus the detection function is $$\delta(n) = \begin{cases} 1, & \text{if } (d(n) > T) \,\&(\delta(m) = 0, \forall m\colon n - L < m < n) \\ 0 & \end{cases}.$$

In the following, enhanced SAOC frequency resolution is described.

The frequency resolution obtained from the standard SAOC-analysis is limited to the number of parametric bands, having the maximum value of 28 in standard SAOC. They are obtained from a hybrid filter bank consisting of a 64-band QMF-analysis followed by a hybrid filtering stage on the lowest bands further dividing them into up to 4 complex sub-bands. The frequency bands obtained are grouped into parametric bands mimicking the critical band resolution of human auditory system. The grouping allows reducing the necessitated side information data rate.

The existing system produces a reasonable separation quality given the reasonably low data rate. The main problem is the insufficient frequency resolution for a clean separation of tonal sounds. This is exhibited as a "halo" of other objects surrounding the tonal components of an object. Perceptually this is observed as roughness or a vocoder-like artifact. The detrimental effect of this halo can be reduced by increasing the parametric frequency resolution. It was noted, that a resolution equal or higher than 512 bands (at 44.1 kHz sampling rate) produces perceptually good separation in the test signals. This resolution could be obtained by extending the hybrid filtering stage of the existing system, but the hybrid filters would need to be of quite a high order for a sufficient separation leading into a high computational cost.

A simple way of obtaining the necessitated frequency resolution is to use a DFT-based time-frequency transform. These can be implemented efficiently through a Fast Fourier Transform (FFT) algorithm. Instead of a normal DFT, CMDCT or ODFT are considered as alternatives. The difference is that the latter two are odd and the obtained spectrum contains pure positive and negative frequencies. Compared to a DFT, the frequency bins are shifted by a 0.5 bin-width. In DFT one of the bins is centred at 0 Hz and another at the Nyquist-frequency. The difference between ODFT and CMDCT is that CMDCT contains an additional post-modulation operation affecting the phase spectrum. The benefit from this is that the resulting complex spectrum consists of the Modified Discrete Cosine Transform (MDCT) and the Modified Discrete Sine Transform (MDST).

A DFT-based transform of length N produces a complex spectrum with N values. When the sequence transformed is real-valued, only N/2 of these values are needed for a perfect reconstruction; the other N/2 values can be obtained from the given ones with simple manipulations. The analysis normally operates on taking a frame of N time-domain samples from the signal, applying a windowing function on the values, and then calculating the actual transform on the windowed data. The consecutive blocks overlap temporally 50% and the windowing functions are designed so that the squares of consecutive windows will sum into unity. This guarantees that when the windowing function is applied twice on the data (once analysing the time-domain signal, and a second time after the synthesis transform before overlap-add), the analysis-plus-synthesis chain without signal modifications is lossless.

Given the 50% overlap between consecutive frames and a frame length of 2048 samples, the effective temporal resolution is 1024 samples (corresponding to 23.2 ms at 44.1 kHz sampling rate). This is not small enough for two reasons: firstly, it would be desirable to be able to decode bit streams produced by a standard SAOC encoder, and secondly, analysing signals in an enhanced SAOC encoder with a finer temporal resolution, if necessitated.

In SAOC, it is possible to group multiple blocks into parameter frames. It is assumed that the signal properties remain similar enough over the parameter frame for it to be characterized with a single parameter set. The parameter frame lengths normally encountered in standard SAOC are 16 or 32 QMF-frames (lengths up to 72 are allowed by the standard). Similar grouping can be done when using a filter bank with a high frequency resolution. When the signal properties do not change during a parameter frame, the grouping provides coding efficiency without quality degradations. However, when the signal properties change within the parameter frame, the grouping induces errors. Standard SAOC allows defining a default grouping length, which is used with quasi-stationary signals, but also defining parameter sub-blocks. The sub-blocks define groupings shorter than the default length, and the parameterization is done on each sub-block separately. Because of the temporal resolution of the underlying QMF-bank, the resulting temporal resolution is 64 time-domain samples, which is much finer than the resolution obtainable using a fixed filter bank with high frequency-resolution. This requirement affects the enhanced SAOC decoder.

Using a filter bank with a large transform length provides a good frequency resolution, but the temporal resolution is degraded at the same time (the so-called uncertainty principle). If the signal properties change within a single analysis frame, the low temporal resolution may cause blurring in the synthesis output. Therefore, it would be beneficial to obtain a sub-frame temporal resolution in locations of considerable signal changes. The sub-frame temporal resolution leads naturally into a lower frequency resolution, but it is assumed that during a signal change the temporal resolution is the more important aspect to be captured accurately. This sub-frame temporal resolution requirement mainly affects the enhanced SAOC encoder (and consequently also the decoder).

The same solution principle can be used in both cases: use long analysis frames when the signal is quasi-stationary (no transients detected) and when there are not parameter borders. When either of the two conditions fails, employ block length switching scheme. An exception to this condition can be made on parameter borders which reside between undivided frame groups and coincide with the cross-over point between two long windows (while decoding an standard SAOC bit stream). It is assumed that in such a case the signal properties remain stationary enough for the high-resolution filter bank. When a parameter border is signalled (from the bit stream or transient detector), the framing is adjusted to use a smaller frame-length, thus improving the temporal resolution locally.

The first two embodiments use the same underlying window sequence construction mechanism. A prototype window function $f(n,N)$ is defined for the index $0 \le n \le N-1$ for a window length N. Designing a single window $w_k(n)$, three control points are needed, namely the centres of the previous, current, and the next window, $c_{k-1}$, $c_k$, and $c_{k+1}$.

Using them, the windowing function is defined as $$w_k(n) = \begin{cases} f(n, 2(c_k - c_{k-1})), & \text{for } 0 \le n < c_k - c_{k-1} \\ f(n - 2c_k + c_{k-1} + c_{k+1}, 2(c_{k+1} - c_k)), & \text{for } c_k - c_{k-1} \le n < c_{k+1} - c_{k-1} \end{cases}.$$

The actual window location is then $\lceil c_{k-1} \rceil \le m \le \lfloor c_{k+1} \rfloor$ with $n = m - \lceil c_{k-1} \rceil$. The prototype window function used in the illustrations is sinusoidal window defined as $$f(n, N) = \sin\left(\frac{\pi(2n+1)}{2N}\right),$$

but also other forms can be used.

In the following, cross-over at a transient according to an embodiment is described.

Figure 9:
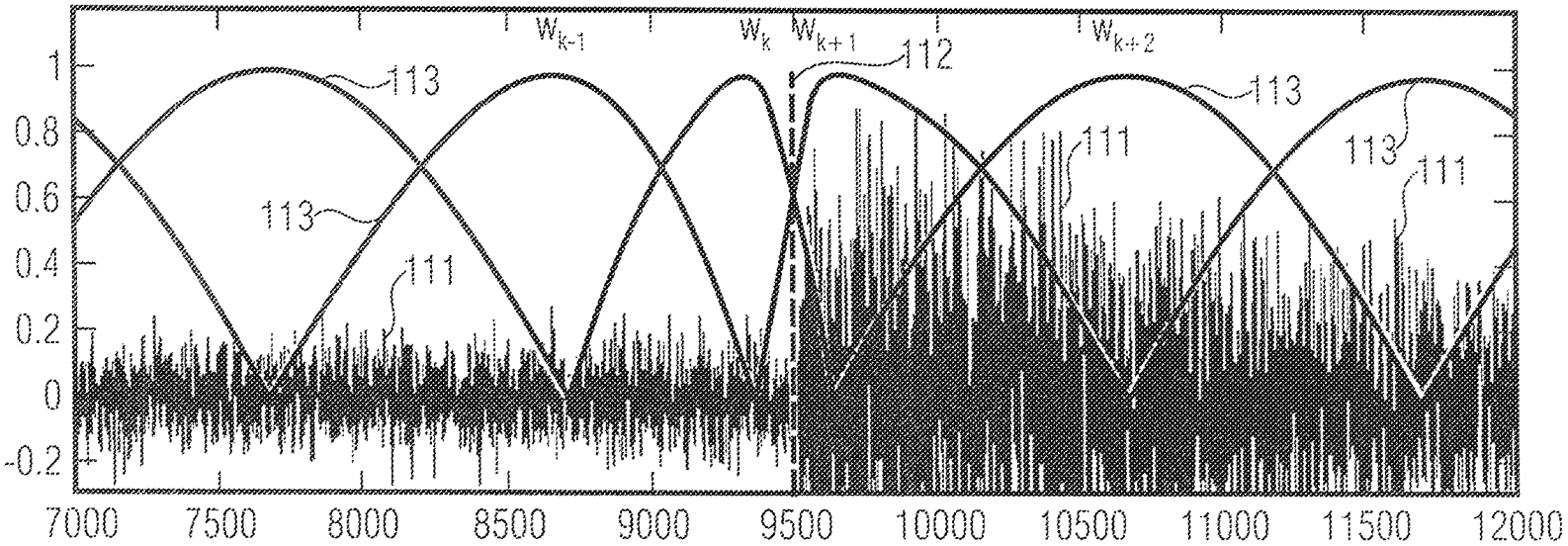
FIG. 9 illustrates the adaptation of the normal windowing sequence to accommodate a window cross-over point at the transient.

FIG. 9 is an illustration of the principle of the "cross-over at transient" block switching scheme. In particular, FIG. 9 illustrates the adaptation of the normal windowing sequence to accommodate a window cross-over point at the transient. The line 111 represents the time-domain signal samples, the vertical line 112 the location t of the detected transient (or a parameter border from the bit stream), and the lines 113 illustrate the windowing functions and their temporal ranges. This scheme necessitates deciding amount the overlap between the two windows $w_k$ and $w_{k+1}$ around the transient, defining the window steepness. When the overlap length is set to a small value, the windows have their maximum points close to the transient and the sections crossing the transient decay fast. The overlap lengths can also be different before and after the transient. In this approach, the two windows or frames surrounding the transient will be adjusted in length. The location of the transient defines the centres of the surrounding windows to be $c_k = t - l_b$ and $c_{k+1} = t + l_a$, in which $l_b$ and $l_a$ are the overlap length before and after the transient, respectively. With these defined, the equation above can be used.

In the following, transient isolation according to an embodiment is described.

Figure 10:
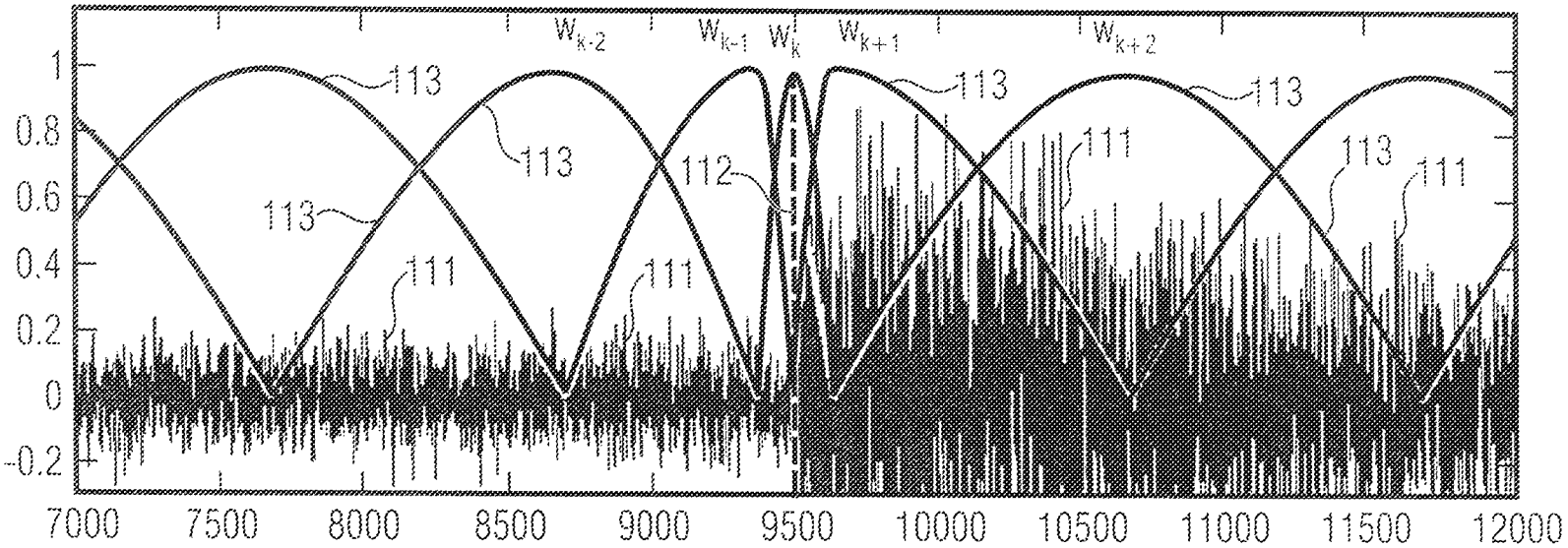
FIG. 10 illustrates a transient isolation block switching scheme according to an embodiment.

FIG. 10 illustrates the principle of the transient isolation block switching scheme according to an embodiment. A short window $w_k$ is centred on the transient, and the two neighbouring windows $w_{k-1}$ and $w_{k+1}$ are adjusted to complement the short window. Effectively the neighbouring windows are limited to the transient location, so the previous window contains only signal before the transient, and the following window contains only signal after the transient. In this approach the transient defines the centers for three windows $c_{k-1} = t - l_b$, $c_k = t$, and $c_{k+1} = t + l_a$, where $l_b$ and $l_a$ define the desired window range before and after the transient. With these defined, the equation above can be used.

In the following, AAC-like framing according to an embodiment is described.

The degrees of freedom of the two earlier windowing schemes may not be needed. The differing transient processing is also employed in the field of perceptual audio coding. There the aim is to reduce the temporal spreading of the transient which would cause so called pre-echoes. In the MPEG-2/4 AAC [AAC], two basic window lengths are used: LONG (with 2048-sample length), and SHORT (with 256-sample length). In addition to these two, also two transition windows are defined to enable the transition from a LONG to SHORT and vice versa. As an additional constraint, the SHORT-windows are necessitated to occur in groups of 8 windows. This way, the stride between windows and window groups remains at a constant value of 1024 samples.

If the SAOC system employs an AAC-based codec for the object signals, the downmix, or the object residuals, it would be beneficial to have a framing scheme that can be easily synchronized with the codec. For this reason, a block switching scheme based on the AAC-windows is described.

Figure 11:
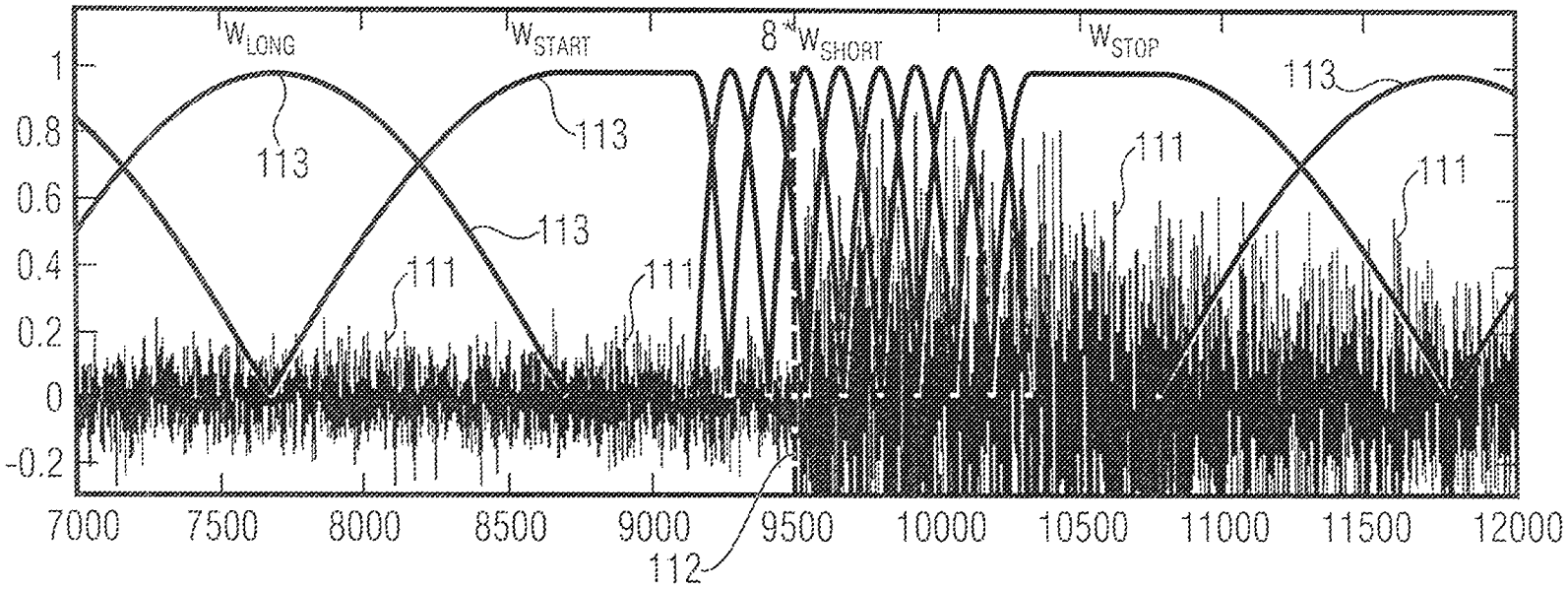
FIG. 11 illustrates a signal with a transient and the resulting AAC-like windowing sequence according to an embodiment.

FIG. 11 depicts an AAC-like block switching example. In particular, FIG. 11 illustrates the same signal with a transient and the resulting AAC-like windowing sequence. It can be seen that the temporal location of the transient is covered with 8 SHORT-windows, which are surrounded by transition windows from and to LONG-windows. It can be seen from the illustration that the transient itself is neither centred in a single window nor at the cross-over point between two windows. This is because the window locations are fixed to a grid, but this grid guarantees the constant stride at the same time. The resulting temporal rounding error is assumed to be small enough to be perceptually irrelevant compared to the errors caused by using LONG-windows only.

The windows are defined as:

The LONG window: $w_{LONG}(n) = f(n, N_{LONG})$, with $N_{LONG} = 2048$.

The SHORT window: $w_{SHORT}(n) = f(n, N_{SHORT})$, with $N_{SHORT} = 256$.

The transition window from LONG to SHORTs $$w_{START}(n) = \begin{cases} f(n, N_{LONG}), & \text{for } 0 \le n < \frac{N_{LONG}}{2} \\ 1, & \text{for } \frac{N_{LONG}}{2} \le n < \frac{2N_{LONG} + 7N_{SHORT}}{4} \\ f(n, N_{SHORT}), & \text{for } \frac{2N_{LONG} + 7N_{SHORT}}{4} \le n < \frac{2N_{LONG} + 9N_{SHORT}}{4} \\ 0, & \text{for } \frac{2N_{LONG} + 9N_{SHORT}}{4} \le n < N_{LONG} \end{cases}.$$

The transition window from SHORTs to LONG $w_{STOP}(n) = w_{START}(N_{LONG} - n - 1)$.

In the following, implementation variants according to embodiments are described.

Regardless of the block switching scheme, another design choice is the length of the actual t/f-transform. If the main target is to keep the following frequency-domain operations simple across the analysis frames, a constant transform length can be used. The length is set to an appropriate large value, e.g., corresponding to the length of the longest allowed frame. If the time-domain frame is shorter than this value, then it is zero-padded to the full length. It should be noted that even though after the zero-padding the spectrum has a greater number of bins, the amount of actual information is not increased compared to a shorter transform. In this case, the kernel matrices K(b, f, n) have the same dimensions for all values of n.

Another alternative is to transform the windowed frame without zero-padding. This has a smaller computational complexity than with a constant transform length. However, the differing frequency resolutions between consecutive frames need to be taken into account with the kernel matrices K(b, f, n).

In the following, extended hybrid filtering according to an embodiment is described.

Another possibility for obtaining a higher frequency resolution would be to modify the hybrid filter bank used in standard SAOC for a finer resolution. In standard SAOC, only the lowest three of the 64 QMF-bands are passed through the Nyquist-filter bank sub-dividing the band contents further.

Figure 12:
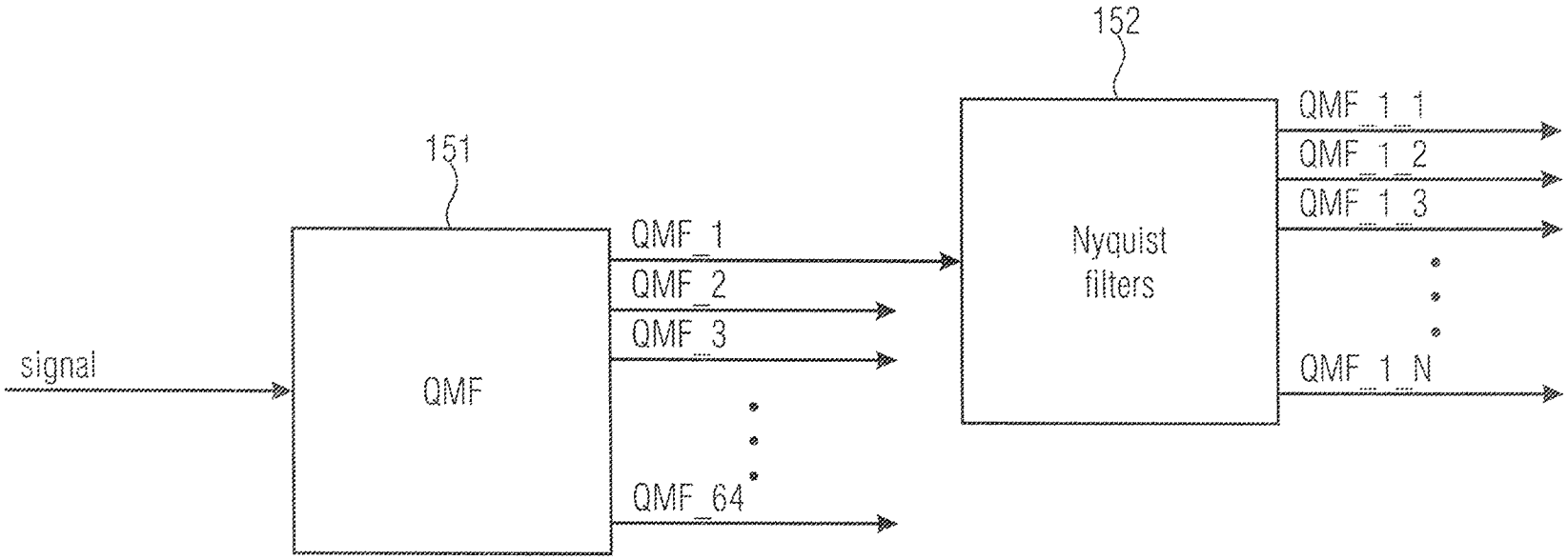
FIG. 12 illustrates extended QMF hybrid filtering.

FIG. 12 illustrates extended QMF hybrid filtering. The Nyquist filters are repeated for each QMF-band separately, and the outputs are combined for a single high-resolution spectrum. In particular, FIG. 12 illustrates how to obtain a frequency resolution comparable to the DFT-based approach would necessitate sub-dividing each QMF-band into, e.g., 16 sub-bands (necessitating complex filtering into 32 sub-bands). The drawback of this approach is that the filter prototypes necessitated are long due to the narrowness of the bands. This causes some processing delay and increases the computational complexity.

An alternative way is to implement the extended hybrid filtering by replacing the sets of Nyquist filters by efficient filter banks/transforms (e.g., "zoom" DFT, Discrete Cosine Transform, etc.). Furthermore, the aliasing contained in the resulting high-resolution spectral coefficients, which is caused by the leakage effects of the first filter stage (here: QMF), can be substantially reduced by an aliasing cancellation post-processing of the high-resolution spectral coefficients similar to the well-known MPEG-1/2 Layer 3 hybrid filter bank [FB] [MPEG-1].

Figure 1B:
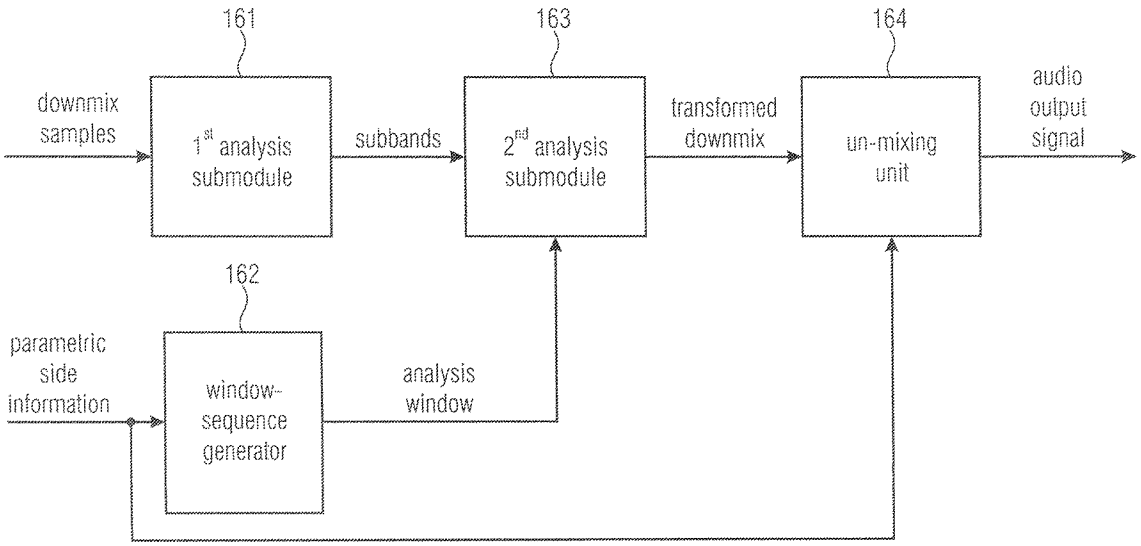
FIG. 1*b* illustrates a decoder according to another embodiment.

FIG. 1*b* illustrates a decoder for generating an audio output signal comprising one or more audio output channels from a downmix signal comprising a plurality of time-domain downmix samples according to a corresponding embodiment. The downmix signal encodes two or more audio object signals.

The decoder comprises a first analysis submodule 161 for transforming the plurality of time-domain downmix samples to obtain a plurality of subbands comprising a plurality of subband samples.

Moreover, the decoder comprises a window-sequence generator 162 for determining a plurality of analysis windows, wherein each of the analysis windows comprises a plurality of subband samples of one of the plurality of subbands, wherein each analysis window of the plurality of analysis windows has a window length indicating the number of subband samples of said analysis window. The window-sequence generator 162 is configured to determine the plurality of analysis windows, e.g., based on parametric side information, so that the window length of each of the analysis windows depends on a signal property of at least one of the two or more audio object signals.

Furthermore, the decoder comprises a second analysis module 163 for transforming the plurality of subband samples of each analysis window of the plurality of analysis windows depending on the window length of said analysis window to obtain a transformed downmix.

Furthermore, the decoder comprises an un-mixing unit 164 for un-mixing the transformed downmix based on parametric side information on the two or more audio object signals to obtain the audio output signal.

In other words: the transform is conducted in two phases. In a first transform phase, a plurality of subbands each comprising a plurality of subband samples are created. Then, in a second phase, a further transform is conducted. Inter alia, the analysis windows used for the second phase determine the time resolution and frequency resolution of the resulting transformed downmix.

Figure 13:
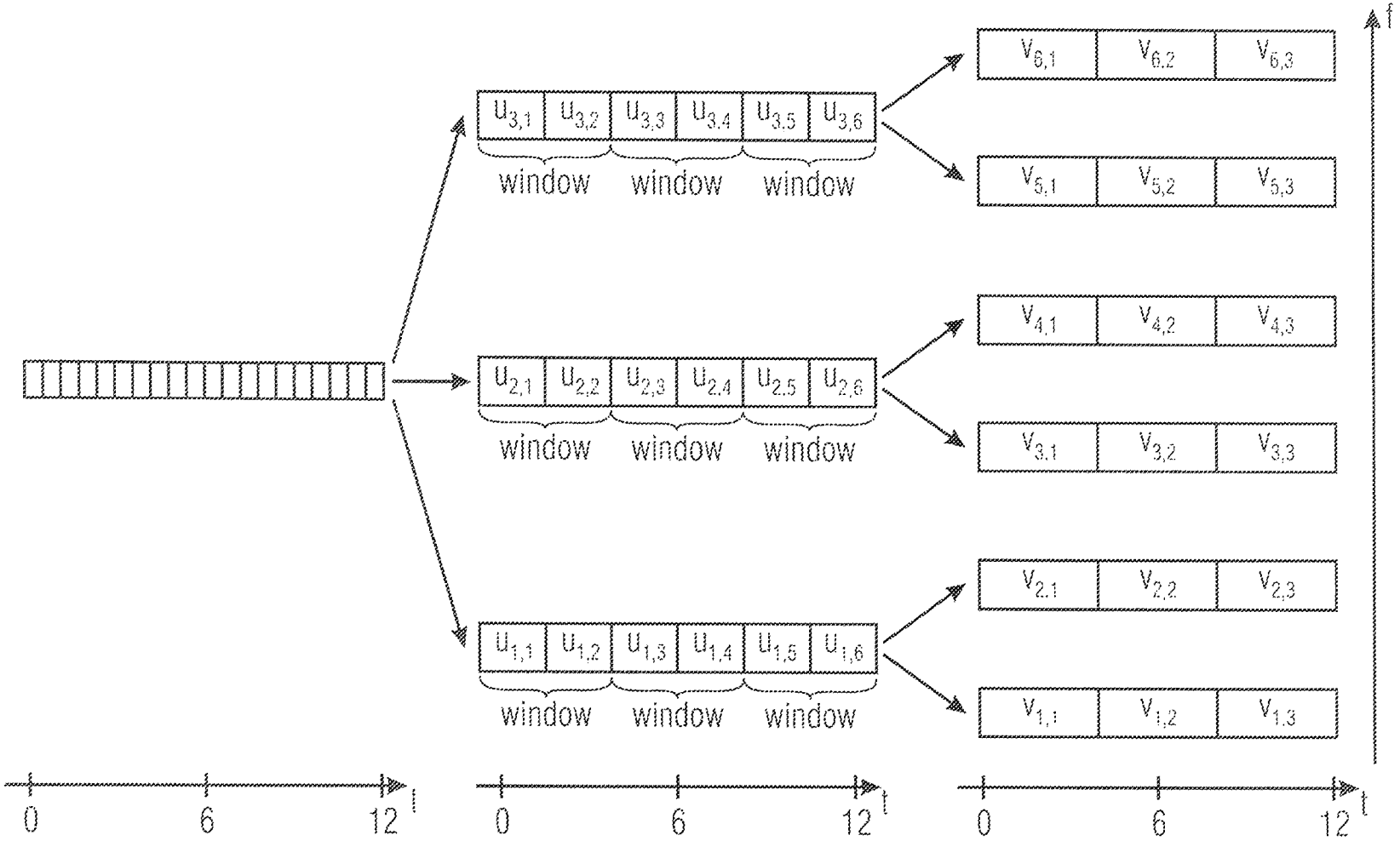
FIG. 13 illustrates an example where short windows are used for the transform.

FIG. 13 illustrates an example where short windows are used for the transform. Using short windows leads to a low frequency resolution, but a high time resolution. Employing short windows may, for example, be appropriate, when a transient is present in the encoded audio object signals (The $u_{i,j}$ indicate subband samples, and the $v_{s,r}$ indicate samples of the transformed downmix in a time-frequency domain.)

Figure 14:
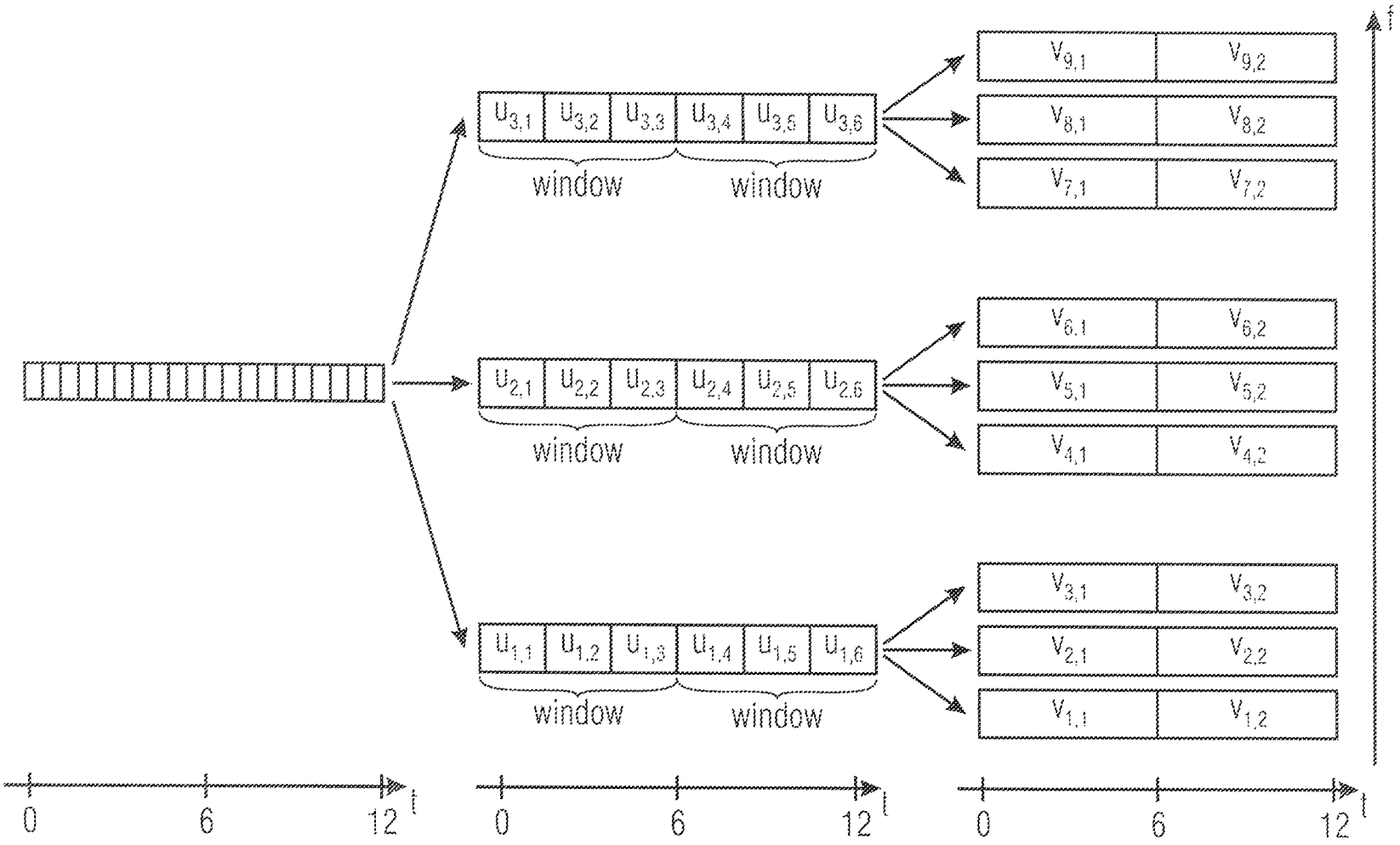
FIG. 14 illustrates an example where longer windows are used for the transform than in the example of FIG. 13.

FIG. 14 illustrates an example where longer windows are used for the transform than in the example of FIG. 13. Using long windows leads to a high frequency resolution, but a low time resolution. Employing long windows may, for example, be appropriate, when a transient not is present in the encoded audio object signals. (Again, the $u_{i,j}$ indicate the subband samples, and the $v_{s,r}$ indicate the samples of the transformed downmix in the time-frequency domain.)

Figure 2B:
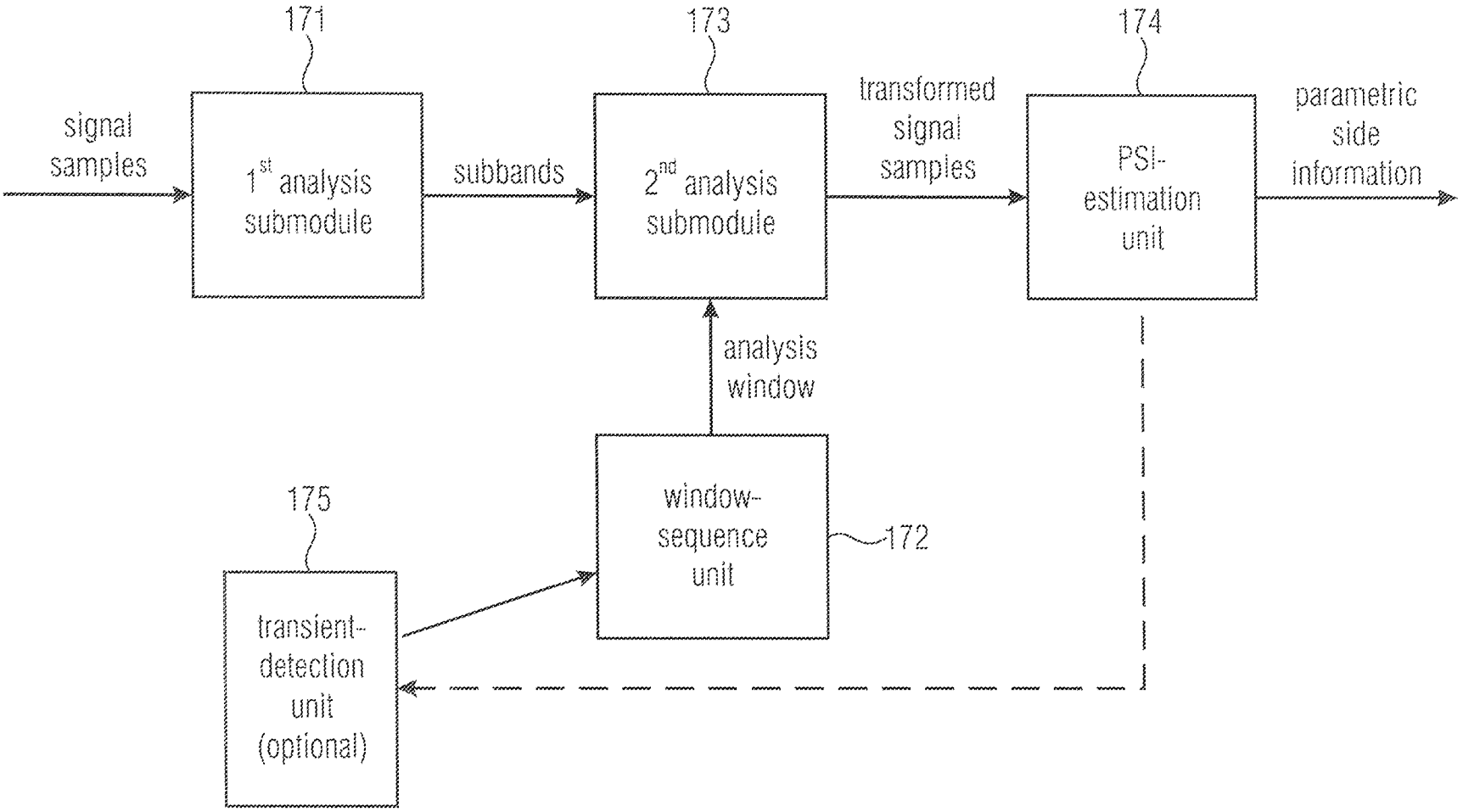
FIG. 2*b* illustrates an encoder for encoding input audio object signals according to another embodiment.

FIG. 2*b* illustrates a corresponding encoder for encoding two or more input audio object signals according to an embodiment. Each of the two or more input audio object signals comprises a plurality of time-domain signal samples.

The encoder comprises a first analysis submodule 171 for transforming the plurality of time-domain signal samples to obtain a plurality of subbands comprising a plurality of subband samples.

Moreover, the encoder comprises a window-sequence unit 172 for determining a plurality of analysis windows, wherein each of the analysis windows comprises a plurality of subband samples of one of the plurality of subbands, wherein each of the analysis windows has a window length indicating the number of subband samples of said analysis window, wherein the window-sequence unit 172 is configured to determine the plurality of analysis windows, so that the window length of each of the analysis windows depends on a signal property of at least one of the two or more input audio object signals. E.g., an (optional) transient-detection unit 175 may provide information on whether a transient is present in one of the input audio object signals to the window-sequence unit 172.

Furthermore, the encoder comprises a second analysis module 173 for transforming the plurality of subband samples of each analysis window of the plurality of analysis windows depending on the window length of said analysis window to obtain transformed signal samples.

Moreover, the encoder comprises a PSI-estimation unit 174 for determining parametric side information depending on the transformed signal samples.

According to other embodiments, two analysis modules for conducting analysis in two phases may be present, but the second module may be switched on and off depending on a signal property.

For example, if a high frequency resolution is necessitated and a low time resolution is acceptable, then the second analysis module is switched on.

In contrast, if a high time resolution is necessitated and a low frequency resolution is acceptable, then the second analysis module is switched off.

Figure 1C:
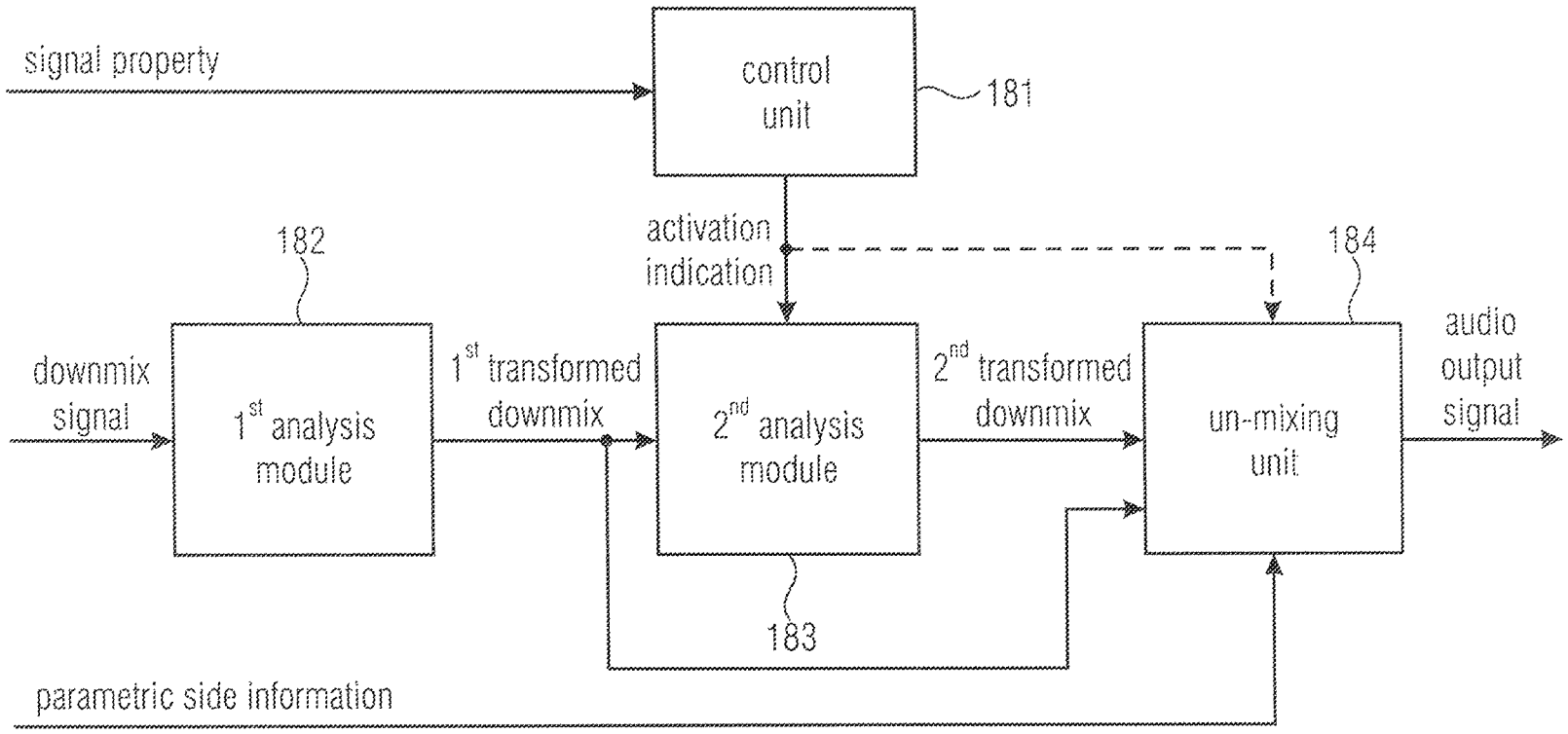
FIG. 1*c* illustrates a decoder according to a further embodiment.

FIG. 1*c* illustrates a decoder for generating an audio output signal comprising one or more audio output channels from a downmix signal according to such an embodiment. The downmix signal encodes one or more audio object signals.

The decoder comprises a control unit 181 for setting an activation indication to an activation state depending on a signal property of at least one of the one or more audio object signals.

Moreover, the decoder comprises a first analysis module 182 for transforming the downmix signal to obtain a first transformed downmix comprising a plurality of first subband channels.

Furthermore, the decoder comprises a second analysis module 183 for generating, when the activation indication is set to the activation state, a second transformed downmix by transforming at least one of the first subband channels to obtain a plurality of second subband channels, wherein the second transformed downmix comprises the first subband channels which have not been transformed by the second analysis module and the second subband channels.

Moreover, the decoder comprises an un-mixing unit 184, wherein the un-mixing unit 184 is configured to un-mix the second transformed downmix, when the activation indication is set to the activation state, based on parametric side information on the one or more audio object signals to obtain the audio output signal, and to un-mix the first transformed downmix, when the activation indication is not set to the activation state, based on the parametric side information on the one or more audio object signals to obtain the audio output signal.

Figure 15:
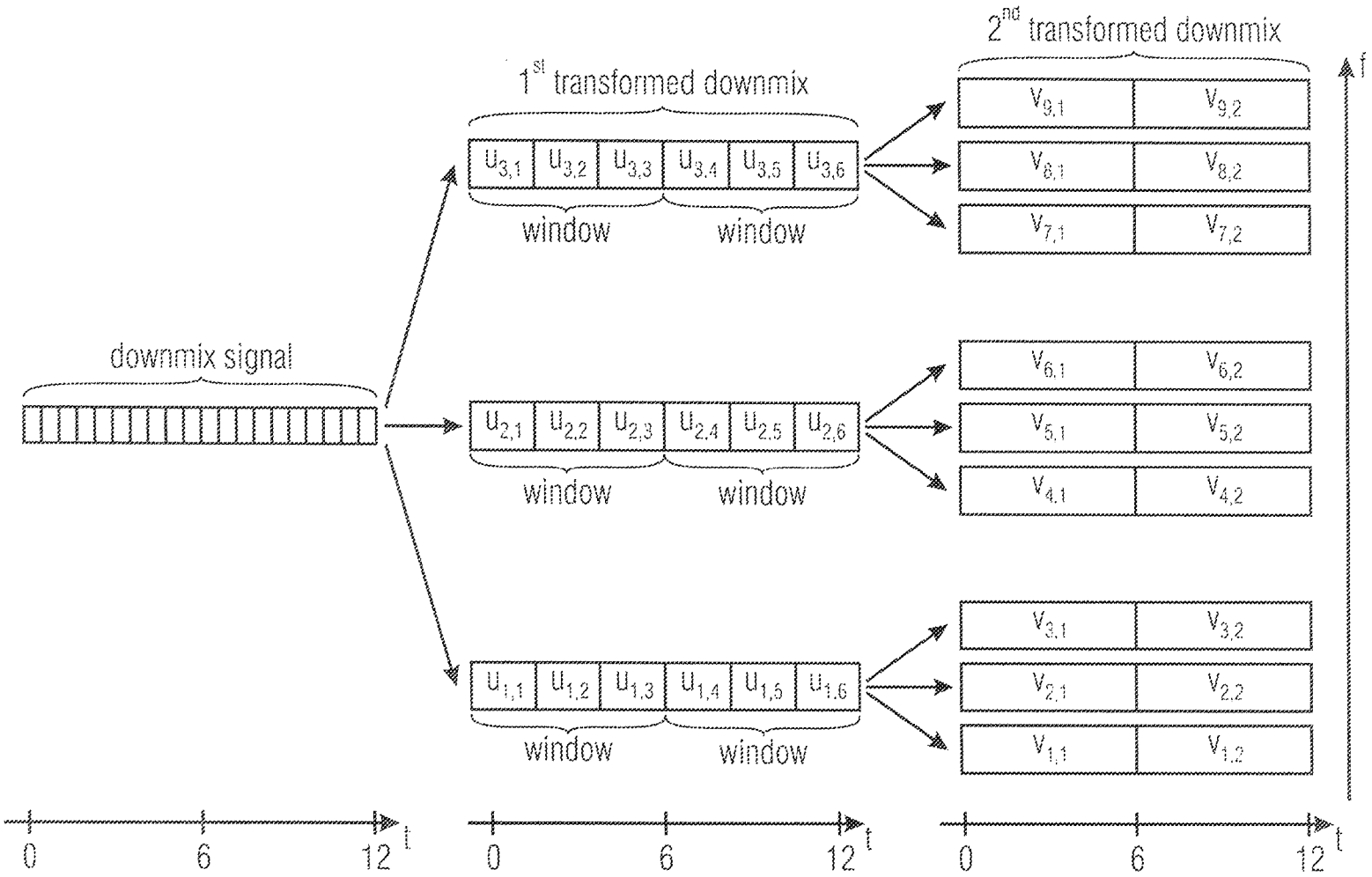
FIG. 15 illustrates an example, where a high frequency resolution and a low time resolution is realized.

FIG. 15 illustrates an example, where a high frequency resolution is necessitated and a low time resolution is acceptable. Consequently, the control unit 181 switches the second analysis module on by setting the activation indication to the activation state (e.g. by setting a boolean variable "activation_indication" to "activation_indication=true"). The downmix signal is transformed by the first analysis module 182 (not shown in FIG. 15) to obtain a first transformed downmix. In the example, of FIG. 15, the transformed downmix has three subbands. In more realistic application scenarios, the transformed downmix may, for example, have, e.g., 32 or 64 subbands. Then, the first transformed downmix is transformed by the second analysis module 183 (not shown in FIG. 15) to obtain a second transformed downmix. In the example, of FIG. 15, the transformed downmix has nine subbands. In more realistic application scenarios, the transformed downmix may, for example, have, e.g., 512, 1024 or 2048 subbands. The un-mixing unit 184 will then un-mix the second transformed downmix to obtain the audio output signal.

For example, the un-mixing unit 184 may receive the activation indication from the control unit 181. Or, for example, whenever the un-mixing unit 184 receives a second transformed downmix from the second analysis module 183, the un-mixing unit 184 concludes that the second transformed downmix has to be un-mixed; whenever the un-mixing unit 184 does not receive a second transformed downmix from the second analysis module 183, the un-mixing unit 184 concludes that the first transformed downmix has to be un-mixed.

Figure 16:
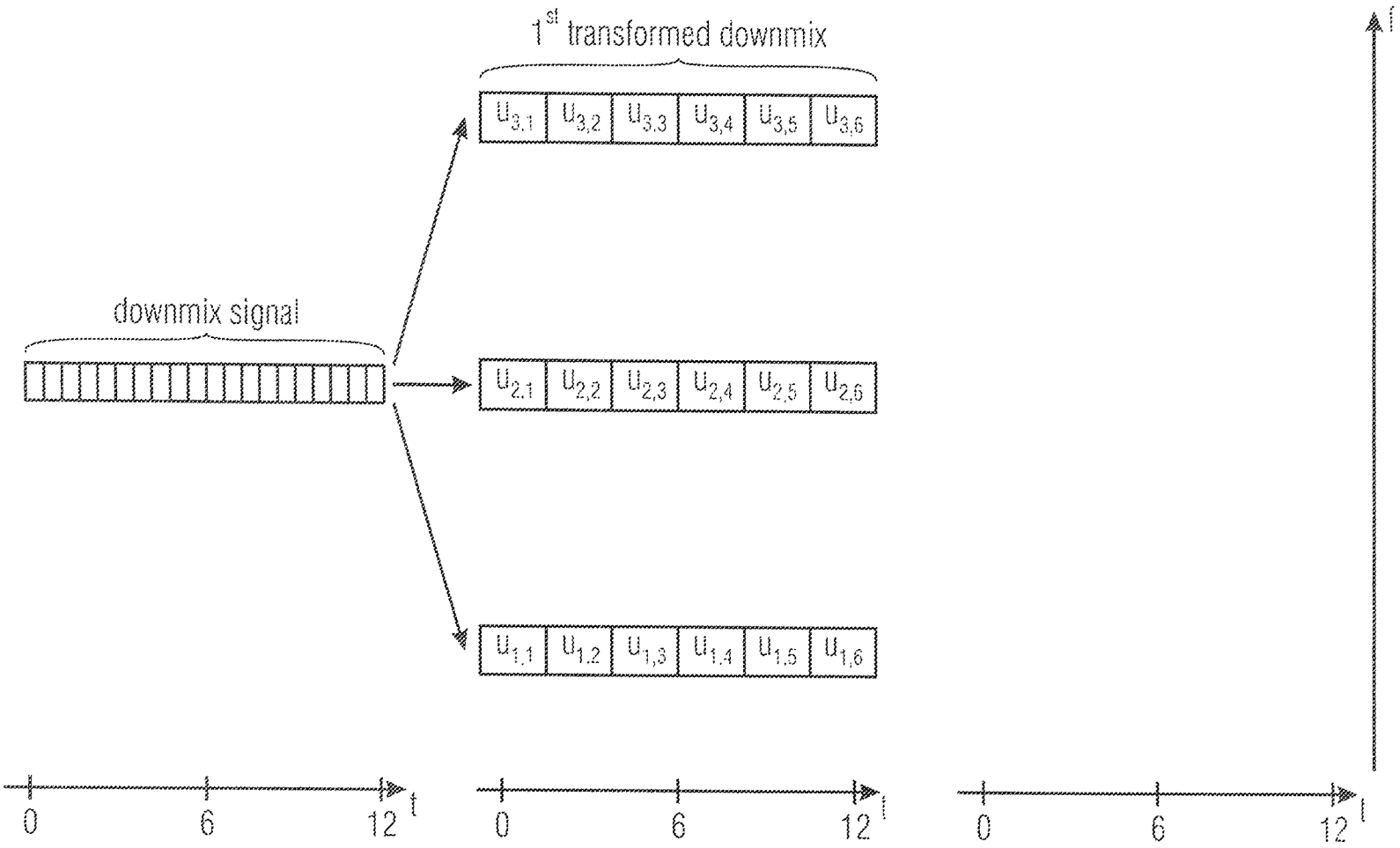
FIG. 16 illustrates an example, where a high time resolution and a low frequency resolution is realized.

FIG. 16 illustrates an example, where a high time resolution is necessitated and a low frequency resolution is acceptable. Consequently, the control unit 181 switches the second analysis module off by setting the activation indication to a state different from the activation state (e.g. by setting the boolean variable "activation_indication" to "activation_indication=false"). The downmix signal is transformed by the first analysis module 182 (not shown in FIG. 16) to obtain a first transformed downmix. Then, in contrast to FIG. 15, the first transformed downmix is not once more transformed by the second analysis module 183. Instead, the un-mixing unit 184 will un-mix first second transformed downmix to obtain the audio output signal.

According to an embodiment, the control unit 181 is configured to set the activation indication to the activation state depending on whether at least one of the one or more audio object signals comprises a transient indicating a signal change of the at least one of the one or more audio object signals.

In another embodiment, a subband transform indication is assigned to each of the first subband channels. The control unit 181 is configured to set the subband transform indication of each of the first subband channels to a subband-transform state depending on the signal property of at least one of the one or more audio object signals. Moreover, the second analysis module 183 is configured to transform each of the first subband channels, the subband transform indication of which is set to the subband-transform state, to obtain the plurality of second subband channels, and to not transform each of the second subband channels, the subband transform indication of which is not set to the subband-transform state.

Figure 17:
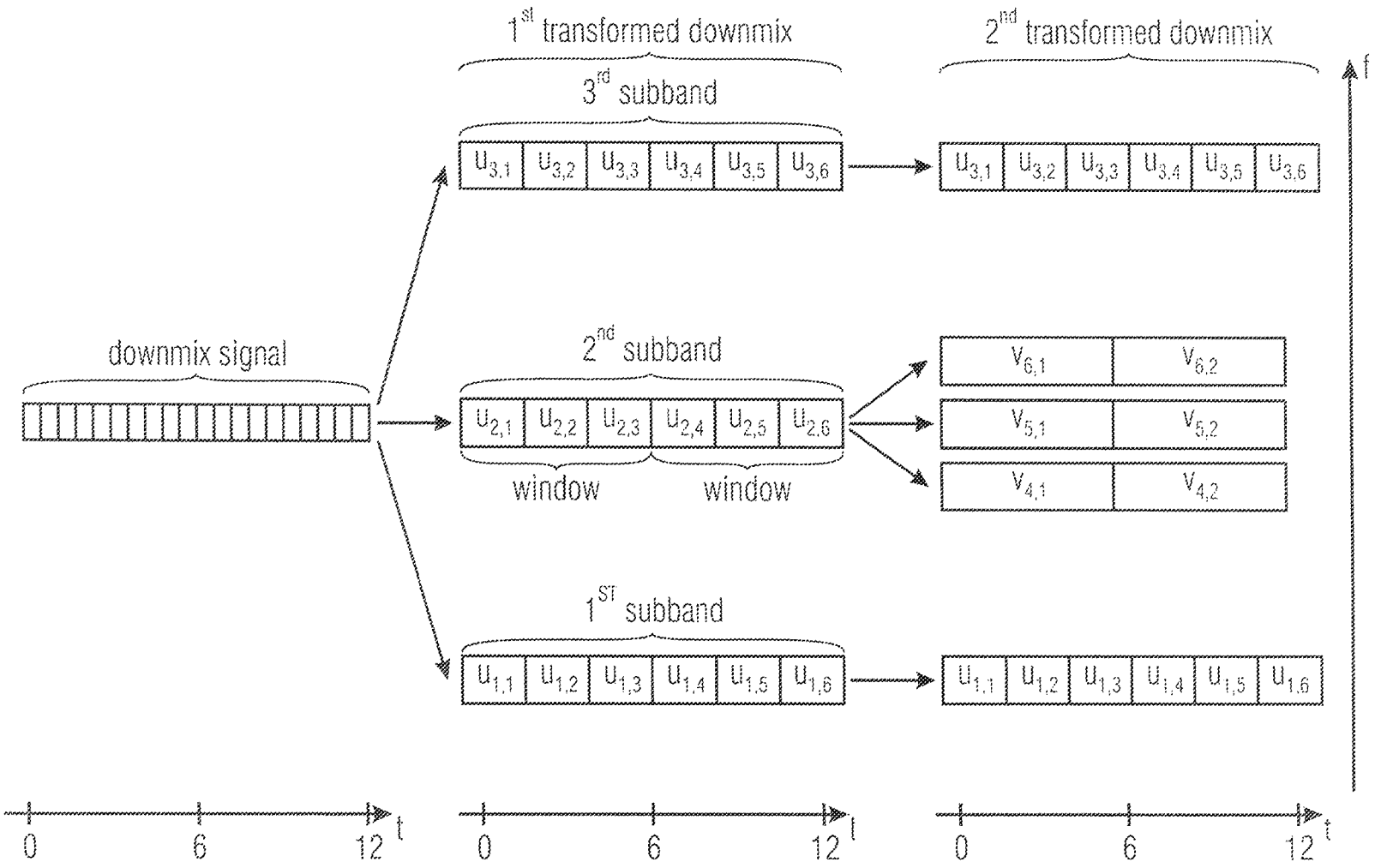
FIG. 17 illustrates a first example, where an intermediate time resolution and an intermediate frequency resolution is realized.

FIG. 17 illustrates an example, where the control unit 181 (not shown in FIG. 17) did set the subband transform indication of the second subband to the subband-transform state (e.g., by setting a boolean variable "subband_transform_indication_2" to "subband transform_indication_2=true"). Thus, the second analysis module 183 (not shown in FIG. 17) transforms the second subband to obtain three new "fine-resolution" subbands. In the example of FIG. 17, the control unit 181 did not set the subband transform indication of the first and third subband to the subband-transform state (e.g., this may be indicated by the control unit 181 by setting boolean variables "subband_transform_indication_1" and "subband_transform_indication_3" to "subband_transform_indication_1=false" and "subband transform_indication_3=false"). Thus, the second analysis module 183 does not transform the first and third subband. Instead, the first subband and the third subband themselves are used as subbands of the second transformed downmix.

Figure 18:
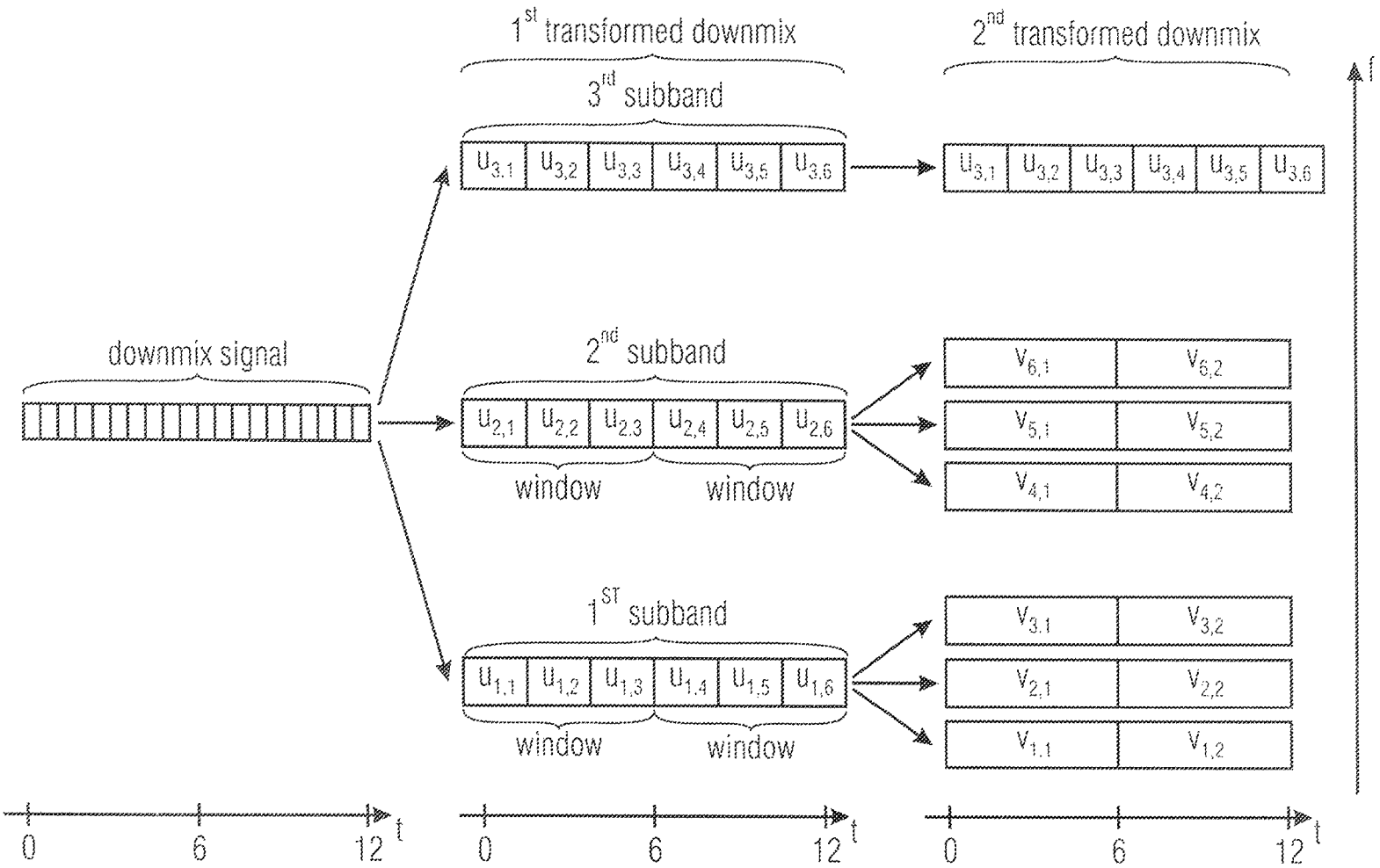
FIG. 18 illustrates a first example, where an intermediate time resolution and an intermediate frequency resolution is realized.

FIG. 18 illustrates an example, where the control unit 181 (not shown in FIG. 18) did set the subband transform indication of the first and second subband to the subband-transform state (e.g. by setting the boolean variable "subband_transform_indication_1" to "subband transform_indication_1=true" and, e.g., by setting the Boolean variable "subband_transform_indication_2" to "subband transform_indication_2=true"). Thus, the second analysis module 183 (not shown in FIG. 18) transforms the first and second subband to obtain six new "fine-resolution" subbands. In the example of FIG. 18, the control unit 181 did not set the subband transformat indication of the third subband to the subband-transform state (e.g., this may be indicated by the control unit 181 by setting boolean variable "subband_transform_indication_3" to "subband transform_indication_3=false"). Thus, the second analysis module 183 does not transform the third subband. Instead, the third subband itself is used as a subband of the second transformed downmix.

According to an embodiment, the first analysis module 182 is configured to transform the downmix signal to obtain the first transformed downmix comprising the plurality of first subband channels by employing a Quadrature Mirror Filter (QMF).

In an embodiment, the first analysis module 182 is configured to transform the downmix signal depending on a first analysis window length, wherein the first analysis window length depends on said signal property, and/or the second analysis module 183 is configured to generate, when the activation indication is set to the activation state, the second transformed downmix by transforming the at least one of the first subband channels depending on a second analysis window length, wherein the second analysis window length depends on said signal property. Such an embodiment realizes to switch the second analysis module 183 on and off, and to set the length of an analysis window.

In an embodiment, the decoder is configured to generate the audio output signal comprising one or more audio output channels from the downmix signal, wherein the downmix signal encodes two or more audio object signals. The control unit 181 is configured to set the activation indication to the activation state depending the signal property of at least one of the two or more audio object signals. Moreover, the un-mixing unit 184 is configured to un-mix the second transformed downmix, when the activation indication is set to the activation state, based on parametric side information on the one or more audio object signals to obtain the audio output signal, and to un-mix the first transformed downmix, when the activation indication is not set to the activation state, based on the parametric side information on the two or more audio object signals to obtain the audio output signal.

Figure 2C:
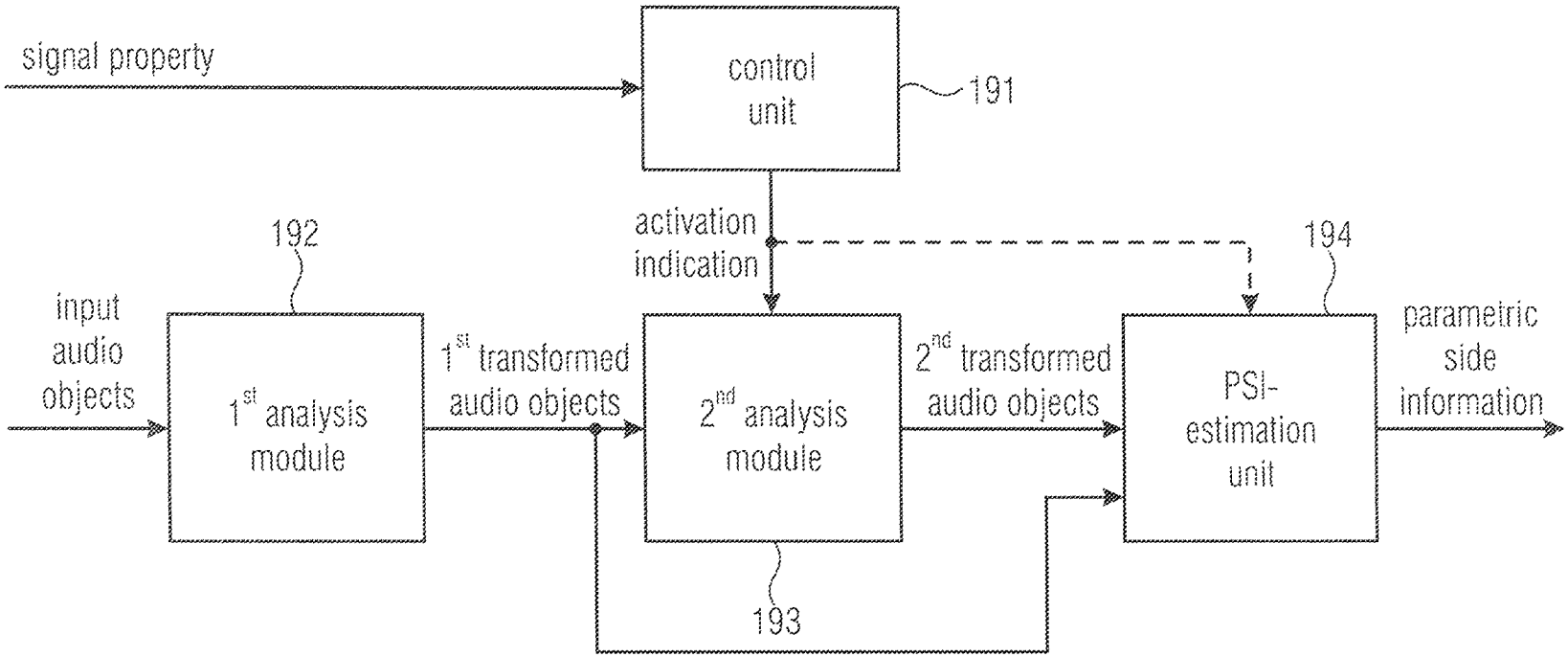
FIG. 2*c* illustrates an encoder for encoding input audio object signals according to a further embodiment.

FIG. 2*c* illustrates an encoder for encoding an input audio object signal according to an embodiment.

The encoder comprises a control unit 191 for setting an activation indication to an activation state depending on a signal property of the input audio object signal.

Moreover, the encoder comprises a first analysis module 192 for transforming the input audio object signal to obtain a first transformed audio object signal, wherein the first transformed audio object signal comprises a plurality of first subband channels.

Furthermore, the encoder comprises a second analysis module 193 for generating, when the activation indication is set to the activation state, a second transformed audio object signal by transforming at least one of the plurality of first subband channels to obtain a plurality of second subband channels, wherein the second transformed audio object signal comprises the first subband channels which have not been transformed by the second analysis module and the second subband channels.

Moreover, the encoder comprises a PSI-estimation unit 194, wherein the PSI-estimation unit 194 is configured to determine parametric side information based on the second transformed audio object signal, when the activation indication is set to the activation state, and to determine the parametric side information based on the first transformed audio object signal, when the activation indication is not set to the activation state.

According to an embodiment, the control unit 191 is configured to set the activation indication to the activation state depending on whether the input audio object signal comprises a transient indicating a signal change of the input audio object signal.

In another embodiment, a subband transform indication is assigned to each of the first subband channels. The control unit 191 is configured to set the subband transform indication of each of the first subband channels to a subband-transform state depending on the signal property of the input audio object signal. The second analysis module 193 is configured to transform each of the first subband channels, the subband transform indication of which is set to the subband-transform state, to obtain the plurality of second subband channels, and to not transform each of the second subband channels, the subband transform indication of which is not set to the subband-transform state.

According to an embodiment, the first analysis module 192 is configured to transform each of the input audio object signals by employing a quadrature mirror filter.

In another embodiment, the first analysis module 192 is configured to transform the input audio object signal depending on a first analysis window length, wherein the first analysis window length depends on said signal property, and/or the second analysis module 193 is configured to generate, when the activation indication is set to the activation state, the second transformed audio object signal by transforming at least one of the plurality of first subband channels depending on a second analysis window length, wherein the second analysis window length depends on said signal property.

According to another embodiment, the encoder is configured to encode the input audio object signal and at least one further input audio object signal. The control unit 191 is configured to set the activation indication to the activation state depending on the signal property of the input audio object signal and depending on a signal property of the at least one further input audio object signal. The first analysis module 192 is configured to transform at least one further input audio object signal to obtain at least one further first transformed audio object signal, wherein each of the at least one further first transformed audio object signal comprises a plurality of first subband channels. The second analysis module 193 is configured to transform, when the activation indication is set to the activation state, at least one of the plurality of first subband channels of at least one of the at least one further first transformed audio object signals to obtain a plurality of further second subband channels. Moreover, the PSI-estimation unit 194 is configured to determine the parametric side information based on the plurality of further second subband channels, when the activation indication is set to the activation state.

The inventive method and apparatus alleviates the aforementioned drawbacks of the state of the art SAOC processing using a fixed filter bank or time-frequency transform. A better subjective audio quality can be obtained by dynamically adapting the time/frequency resolution of the transforms or filter banks employed to analyze and synthesize audio objects within SAOC. At the same time, artifacts like pre- and post-echoes caused by the lack of temporal precision and artifacts like auditory roughness and double-talk caused by insufficient spectral precision can be minimized within the same SAOC system. Most importantly, the enhanced SAOC system equipped with the inventive adaptive transform maintains backward compatibility with standard SAOC still providing a good perceptual quality comparable to that of standard SAOC.

Embodiments provide an audio encoder or method of audio encoding or related computer program as described above. Moreover, embodiments provide an audio encoder or method of audio decoding or related computer program as described above. Furthermore, embodiments provide an encoded audio signal or storage medium having stored the encoded audio signal as described above.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM, or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003.

[JSC] C. Faller, "Parametric Joint-Coding of Audio Sources", 120th AES Convention, Paris, 2006.

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April, 2007.

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam, 2008.

[SAOC] ISO/IEC, "MPEG audio technologies—Part 2: Spatial Audio Object Coding (SAOC)," ISO/IEC JTC1/SC29/WG11 (MPEG) International Standard 23003-2:2010.

[AAC] Bosi, Marina; Brandenburg, Karlheinz; Quackenbush, Schuyler; Fielder, Louis; Akagiri, Kenzo; Fuchs, Hendrik; Dietz, Martin, "ISO/IEC MPEG-2 Advanced Audio Coding", J. Audio Eng. Soc, vol 45, no 10, pp. 789-814, 1997.

[ISS1] M. Parvaix and L. Girin: "Informed Source Separation of underdetermined instantaneous Stereo Mixtures using Source Index Embedding", IEEE ICASSP, 2010.

[ISS2] M. Parvaix, L. Girin, J.-M. Brossier: "A watermarking-based method for informed source separation of audio signals with a single sensor", IEEE Transactions on Audio, Speech and Language Processing, 2010.

[ISS3] A. Liutkus and J. Pinel and R. Badeau and L. Girin and G. Richard: "Informed source separation through spectrogram coding and data embedding", Signal Processing Journal, 2011.

[ISS4] A. Ozerov, A. Liutkus, R. Badeau, G. Richard: "Informed source separation: source coding meets source separation", IEEE Workshop on Applications of Signal Processing to Audio and Acoustics, 2011.

[ISS5] Shuhua Zhang and Laurent Girin: "An Informed Source Separation System for Speech Signals", INTERSPEECH, 2011.

[ISS6] L. Girin and J. Pinel: "Informed Audio Source Separation from Compressed Linear Stereo Mixtures", AES 42nd International Conference: Semantic Audio, 2011.

[ISS7] Andrew Nesbit, Emmanuel Vincent, and Mark D. Plumbley: "Benchmarking flexible adaptive time-frequency transforms for underdetermined audio source separation", IEEE International Conference on Acoustics, Speech and Signal Processing, pp. 37-40, 2009.

[FB] B. Edler, "Aliasing reduction in subbands of cascaded filterbanks with decimation", Electronic Letters, vol. 28, No. 12, pp. 1104-1106, June 1992.

[MPEG-1] ISO/IEC JTC1/SC29/WG11 MPEG, International Standard ISO/IEC 11172, Coding of moving pictures and associated audio for digital storage media at up to about 1.5 Mbit/s, 1993.

The invention claimed is:

1. A decoder for generating an audio output signal comprising one or more audio output channels from a downmix signal comprising a plurality of time-domain downmix samples, wherein the downmix signal encodes two or more audio object signals, wherein the decoder comprises:

a window-sequence generator for determining a plurality of analysis windows, wherein each of the analysis windows comprises a plurality of time-domain downmix samples of the downmix signal, wherein each analysis window of the plurality of analysis windows comprises a window length indicating the number of the time-domain downmix samples of said analysis window, wherein the window-sequence generator is configured to determine the plurality of analysis windows so that the window length of each of the analysis windows depends on a signal property of at least one of the two or more audio object signals, a time-frequency-analysis module for transforming the plurality of time-domain downmix samples of each analysis window of the plurality of analysis windows from a time-domain to a time-frequency domain depending on the window length of said analysis window, to acquire a transformed downmix, and an un-mixing unit for un-mixing the transformed downmix based on parametric side information on the two or more audio object signals to acquire the audio output signal.

2. The decoder according to claim 1, wherein the window-sequence generator is configured to determine the plurality of analysis windows, so that a transient, indicating a signal change of at least one of the two or more audio object signals being encoded by the downmix signal, is comprised by a first analysis window of the plurality of analysis windows and by a second analysis window of the plurality of analysis windows, wherein a center $c_k$ of the first analysis window is defined by a location t of the transient according to $c_k=t-l_b$, and a center $c_{k+1}$ of the second analysis window is defined by the location t of the transient according to $c_{k-1}=t+l_a$, wherein $l_a$ and $l_b$ are numbers.

3. The decoder according to claim 1, wherein the window-sequence generator is configured to determine the plurality of analysis windows, so that a transient indicating a signal change of at least one of the two or more audio object signals being encoded by the downmix signal, is comprised by a first analysis window of the plurality of analysis windows, wherein a center $c_k$ of the first analysis window is defined by a location t of the transient according to $c_k=t$, wherein a center $c_{k-1}$ of a second analysis window of the plurality of analysis windows is defined by a location t of the transient according to $c_{k-1}=t-l_b$, and wherein a center $c_{k+1}$ of a third analysis window of the plurality of analysis windows is defined by a location t of the transient according to $c_{k+1}=t+l_a$, wherein $l_a$ and $l_b$ are numbers.

4. The decoder according to claim 1, wherein the window-sequence generator is configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient, indicating a signal change of at least one of the two or more audio object signals being encoded by the downmix signal.

5. A decoder for generating an audio output signal comprising one or more audio output channels from a downmix signal comprising a plurality of time-domain downmix samples, wherein the downmix signal encodes two or more audio object signals, wherein the decoder comprises:

a first analysis submodule for transforming the plurality of time-domain downmix samples to acquire a plurality of subbands comprising a plurality of subband samples, a window-sequence generator for determining a plurality of analysis windows, wherein each of the analysis windows comprises a plurality of subband samples of one of the plurality of subbands, wherein each analysis window of the plurality of analysis windows comprises a window length indicating the number of subband samples of said analysis window, wherein the window-sequence generator is configured to determine the plurality of analysis windows so that the window length of each of the analysis windows depends on a signal property of at least one of the two or more audio object signals, a second analysis module for transforming the plurality of subband samples of each analysis window of the plurality of analysis windows depending on the window length of said analysis window to acquire a transformed downmix, and an un-mixing unit for un-mixing the transformed downmix based on parametric side information on the two or more audio object signals to acquire the audio output signal.

6. An encoder for encoding two or more input audio object signals, wherein each of the two or more input audio object signals comprises a plurality of time-domain signal samples, wherein the encoder comprises:

a window-sequence unit for determining a plurality of analysis windows, wherein each of the analysis windows comprises a plurality of the time-domain signal samples of one of the input audio object signals, wherein each of the analysis windows comprises a window length indicating the number of time-domain signal samples of said analysis window, wherein the window-sequence unit is configured to determine the plurality of analysis windows so that the window length of each of the analysis windows depends on a signal property of at least one of the two or more input audio object signals, a time-frequency-analysis unit for transforming the time-domain signal samples of each of the analysis windows from a time-domain to a time-frequency domain to acquire transformed signal samples, wherein the time-frequency-analysis unit is configured to transform the plurality of time-domain signal samples of each of the analysis windows depending on the window length of said analysis window, and a parametric side information estimation unit for determining parametric side information depending on the transformed signal samples.

7. The encoder according to claim 6, wherein the encoder further comprises a transient-detection unit being configured to determine a plurality of object level differences of the two or more input audio object signals, and being configured to determine, whether a difference between a first one of the object level differences and a second one of object level differences is greater than a threshold value, to determine for each of the analysis windows, whether said analysis window comprises a transient, indicating a signal change of at least one of the two or more input audio object signals.

8. The encoder according to claim 7, wherein the transient-detection unit is configured to employ a detection function d(n) to determine whether the difference between the first one of the object level differences and the second one of object level differences is greater than the threshold value, wherein the detection function d(n) is defined as:

$$d(n) = \sum_{i,j} |\log(OLD_{i,j}(b, n-1)) - \log(OLD_{i,j}(b, n))|$$

wherein n indicates an index, wherein i indicates a first object, wherein j indicates a second object, and wherein b indicates a parametric band.

9. The encoder according to claim 6, wherein the window-sequence unit is configured to determine the plurality of analysis windows, so that a transient, indicating a signal change of at least one of the two or more input audio object signals, is comprised by a first analysis window of the plurality of analysis windows and by a second analysis window of the plurality of analysis windows, wherein a center $c_k$ of the first analysis window is defined by a location t of the transient according to $c_k=t-l_b$, and a center $c_{k+1}$ of the second analysis window is defined by the location t of the transient according to $c_{k+1}=t+l_a$, wherein $l_a$ and $l_b$ are numbers.

10. The encoder according to claim 6, wherein the window-sequence unit is configured to determine the plurality of analysis windows, so that a transient, indicating a signal change of at least one of the two or more input audio object signals, is comprised by a first analysis window of the plurality of analysis windows, wherein a center $c_k$ of the first analysis window is defined by a location t of the transient according to $c_k=t$, wherein a center $c_{k-1}$ of a second analysis window of the plurality of analysis windows is defined by a location t of the transient according to $c_{k-1}=t-l_b$, and wherein a center $c_{k+1}$ of a third analysis window of the plurality of analysis windows is defined by a location t of the transient according to $c_{k+1}=t+l_a$, wherein $l_a$ and $l_b$ are numbers.

11. The encoder according to claim 6, wherein the window-sequence unit is configured to determine the plurality of analysis windows, so that each of the plurality of analysis windows either comprises a first number of time-domain signal samples or a second number of time-domain signal samples, wherein the second number of time-domain signal samples is greater than the first number of time-domain signal samples, and wherein each of the analysis windows of the plurality of analysis windows comprises the first number of time-domain signal samples when said analysis window comprises a transient, indicating a signal change of at least one of the two or more input audio object signals.

12. An encoder for encoding two or more input audio object signals, wherein each of the two or more input audio object signals comprises a plurality of time-domain signal samples, wherein the encoder comprises:

a first analysis submodule for transforming the plurality of time-domain signal samples to acquire a plurality of subbands comprising a plurality of subband samples, a window-sequence unit for determining a plurality of analysis windows, wherein each of the analysis windows comprises a plurality of subband samples of one of the plurality of subbands, wherein each of the analysis windows comprises a window length indicating the number of subband samples of said analysis window, wherein the window-sequence unit is configured to determine the plurality of analysis windows so that the window length of each of the analysis windows depends on a signal property of at least one of the two or more input audio object signals, a second analysis module for transforming the plurality of subband samples of each analysis window of the plurality of analysis windows depending on the window length of said analysis window to acquire transformed signal samples, and a parametric side information estimation unit for determining parametric side information depending on the transformed signal samples.

13. A method for decoding for generating an audio output signal comprising one or more audio output channels from a downmix signal comprising a plurality of time-domain downmix samples, wherein the downmix signal encodes two or more audio object signals, wherein the method comprises:

determining a plurality of analysis windows, wherein each of the analysis windows comprises a plurality of time-domain downmix samples of the downmix signal, wherein each analysis window of the plurality of analysis windows comprises a window length indicating the number of the time-domain downmix samples of said analysis window, wherein determining the plurality of analysis windows is conducted so that the window length of each of the analysis windows depends on a signal property of at least one of the two or more audio object signals, transforming the plurality of time-domain downmix samples of each analysis window of the plurality of analysis windows from a time-domain to a time-frequency domain depending on the window length of said analysis window, to acquire a transformed downmix, and un-mixing the transformed downmix based on parametric side information on the two or more audio object signals to acquire the audio output signal.

14. A method for encoding two or more input audio object signals, wherein each of the two or more input audio object signals comprises a plurality of time-domain signal samples, wherein the method comprises:

determining a plurality of analysis windows, wherein each of the analysis windows comprises a plurality of the time-domain signal samples of one of the input audio object signals, wherein each of the analysis windows comprises a window length indicating the number of time-domain signal samples of said analysis window, wherein determining the plurality of analysis windows is conducted so that the window length of each of the analysis windows depends on a signal property of at least one of the two or more input audio object signals, transforming the time-domain signal samples of each of the analysis windows from a time-domain to a time-frequency domain to acquire transformed signal samples, wherein transforming the plurality of time-domain signal samples of each of the analysis windows depends on the window length of said analysis window, determining parametric side information depending on the transformed signal samples.

15. A method for decoding by generating an audio output signal comprising one or more audio output channels from a downmix signal comprising a plurality of time-domain downmix samples, wherein the downmix signal encodes two or more audio object signals, wherein the method comprises:

transforming the plurality of time-domain downmix samples to acquire a plurality of subbands comprising a plurality of subband samples, determining a plurality of analysis windows, wherein each of the analysis windows comprises a plurality of subband samples of one of the plurality of subbands, wherein each analysis window of the plurality of analysis windows comprises a window length indicating the number of subband samples of said analysis window, wherein determining the plurality of analysis windows is conducted so that the window length of each of the analysis windows depends on a signal property of at least one of the two or more audio object signals, transforming the plurality of subband samples of each analysis window of the plurality of analysis windows depending on the window length of said analysis window to acquire a transformed downmix, and un-mixing the transformed downmix based on parametric side information on the two or more audio object signals to acquire the audio output signal.

16. A method for encoding two or more input audio object signals, wherein each of the two or more input audio object signals comprises a plurality of time-domain signal samples, wherein the method comprises:

transforming the plurality of time-domain signal samples to acquire a plurality of subbands comprising a plurality of subband samples, determining a plurality of analysis windows, wherein each of the analysis windows comprises a plurality of subband samples of one of the plurality of subbands, wherein each of the analysis windows comprises a window length indicating the number of subband samples of said analysis window, wherein determining the plurality of analysis windows is conducted so that the window length of each of the analysis windows depends on a signal property of at least one of the two or more input audio object signals, transforming the plurality of subband samples of each analysis window of the plurality of analysis windows depending on the window length of said analysis window to acquire transformed signal samples, and determining parametric side information depending on the transformed signal samples.

17. A non-transitory computer-readable medium comprising a computer program for implementing the method of claim 13 when being executed on a computer or signal processor.

18. A non-transitory computer-readable medium comprising a computer program for implementing the method of claim 14 when being executed on a computer or signal processor.

19. A non-transitory computer-readable medium comprising a computer program for implementing the method of claim 15 when being executed on a computer or signal processor.

20. A non-transitory computer-readable medium comprising a computer program for implementing the method of claim 16 when being executed on a computer or signal processor.

* * * * *